US010722012B2

(12) United States Patent
Kraus et al.

(10) Patent No.: US 10,722,012 B2
(45) Date of Patent: Jul. 28, 2020

(54) SUITCASE

(71) Applicant: ADOLF WÜRTH GMBH & CO. KG, Künzelsau (DE)

(72) Inventors: Daniel Kraus, Niederstotzingen (DE); Felix Timm, Dornstadt (DE); Johannes Starke, Ellhofen (DE); Simon Koch, Dörzbach (DE); Oliver Oberndörfer, Hardthausen (DE); Wolfgang Hohl, Künzelsau (DE)

(73) Assignee: WÜRTH INTERNATIONAL AG, Chur (CH)

( * ) Notice: Subject to any disclaimer, the term of this patent is extended or adjusted under 35 U.S.C. 154(b) by 200 days.

(21) Appl. No.: 15/535,339

(22) PCT Filed: Nov. 23, 2015

(86) PCT No.: PCT/EP2015/077347
§ 371 (c)(1),
(2) Date: Jun. 12, 2017

(87) PCT Pub. No.: WO2016/091570
PCT Pub. Date: Jun. 16, 2016

(65) Prior Publication Data

US 2017/0318927 A1 Nov. 9, 2017

(30) Foreign Application Priority Data

Dec. 11, 2014 (DE) ..... 10 2014 118 452

(51) Int. Cl.
*A45C 7/00* (2006.01)
*B25H 3/02* (2006.01)
(Continued)

(52) U.S. Cl.
CPC ..... *A45C 7/0045* (2013.01); *A45C 3/00* (2013.01); *A45C 5/00* (2013.01); *A45C 5/03* (2013.01);
(Continued)

(58) Field of Classification Search
CPC ..... A45C 7/0045; A45C 3/00; A45C 5/00; A45C 5/03; A45C 13/02; A45C 2200/10; B25H 3/02; B65D 21/0223
(Continued)

(56) References Cited

U.S. PATENT DOCUMENTS 3,656,594 A * 4/1972 Marks ..... A45C 13/26 16/408
3,891,230 A * 6/1975 Mayer ..... B62B 1/14 280/43.24
(Continued)

FOREIGN PATENT DOCUMENTS

CN 2827660 Y 10/2006
CN 2878219 Y 3/2007
(Continued)

OTHER PUBLICATIONS

Partial English Translation of DE 39 34 760 A1, dated Apr. 25, 1991 (previous cited).
(Continued)

*Primary Examiner* — Tri M Mai
(74) *Attorney, Agent, or Firm* — Lewis Roca Rothgerber Christie LLP

(57) ABSTRACT

Suitcase for transporting goods to be transported, the suitcase having: a corpus; a lid, which is connected, or connectable, to the corpus; and coupling structures provided at the corpus and/or at the lid; wherein in a closed state, an accommodating space for accommodating goods to be transported is formed between the corpus and the lid inaccessibly
(Continued)

from the outside, wherein in an open state, the accommodating space is accessible from the outside, and wherein the coupling structures are formed such that the suitcase and another suitcase, which has coupling structures are, by the coupling structures, one upon the other, selectively: vertically detachably and protected against displacement stackable, or vertically non-removably coupleable with each other.

18 Claims, 10 Drawing Sheets

(51) Int. Cl.

| | |
|---|---|
| ***A45C 5/00*** | (2006.01) |
| ***A45C 3/00*** | (2006.01) |
| ***B65D 21/02*** | (2006.01) |
| ***A45C 5/03*** | (2006.01) |
| ***A45C 13/02*** | (2006.01) |

(52) U.S. Cl.
CPC ..... *A45C 13/02* (2013.01); *B25H 3/02* (2013.01); *B65D 21/0223* (2013.01); *A45C 2200/10* (2013.01)

(58) Field of Classification Search
USPC ..... 190/108, 18 A, 111; 220/23.83
See application file for complete search history.

(56) References Cited

U.S. PATENT DOCUMENTS

| | | | | |
|---|---|---|---|---|
| 4,122,925 | A | 10/1978 | Schultheiss | |
| 4,261,078 | A * | 4/1981 | Edwards | A45C 13/26 16/409 |
| 4,424,841 | A * | 1/1984 | Smith | A45C 7/0086 190/102 |
| 4,693,345 | A | 9/1987 | Mittelmann | |
| 5,699,925 | A | 12/1997 | Petruzzi | |
| 6,015,064 | A * | 1/2000 | Liu | A45C 13/02 206/372 |
| 7,219,969 | B2 * | 5/2007 | Bezzubov | A47B 87/0276 312/107 |
| 7,523,827 | B2 | 4/2009 | Dane et al. | |
| 7,661,530 | B1 * | 2/2010 | Hewitt | A45C 11/24 206/528 |
| 8,561,769 | B2 * | 10/2013 | Andochick | A45C 5/14 190/18 A |
| 8,875,888 | B2 * | 11/2014 | Koenig | B65D 21/0223 206/503 |
| 2002/0074332 | A1 * | 6/2002 | Sagol | A01K 97/06 220/23.4 |
| 2004/0163913 | A1 * | 8/2004 | Tschudy | A45C 5/06 190/111 |
| 2005/0199459 | A1 * | 9/2005 | Harvey | A45C 5/14 190/108 |
| 2007/0080080 | A1 * | 4/2007 | Bellomo | A45C 3/02 206/315.1 |
| 2010/0147642 | A1 * | 6/2010 | Andochick | A45C 5/14 190/18 A |
| 2011/0139777 | A1 | 6/2011 | Sosnovsky et al. | |
| 2012/0228074 | A1 * | 9/2012 | Osler | A45C 5/14 190/18 A |
| 2012/0312812 | A1 * | 12/2012 | Sosnovsky | B25H 3/021 220/23.83 |

FOREIGN PATENT DOCUMENTS

| | | | |
|---|---|---|---|
| CN | 201990010 | U | 9/2011 |
| DE | 0 210 953 | A2 | 2/1987 |
| DE | 39 34 760 | A1 | 4/1991 |
| DE | 42 01 264 | A1 | 7/1993 |
| DE | 199 00 361 | A1 | 7/2000 |
| DE | 20 2010 000 218 | U1 | 8/2010 |
| DE | 20 2009 018 589 | U1 | 5/2012 |
| EP | 0 210 953 | A2 | 2/1987 |
| EP | 2 020 188 | A1 | 2/2009 |

OTHER PUBLICATIONS

Partial English Translation of DE 42 01 264 A1, dated Jul. 22, 1993 (previously cited).
Partial English Translation of DE 199 00 361 A1, dated Jul. 20, 2000 (previously cited).
Partial English Translation of DE 20 2009 018 589 U1, dated May 3, 2012 (previously cited).
Partial English Translation of DE 20 2010 000 218 U1, dated Aug. 5, 2010 (previously cited).
Partial English Translation of EP 2 020 188 A1, dated Feb. 4, 2009 (previously cited).
First Office Action issued by China National Intellectual Property Administration in parallel Chinese Application No. 201580075986.1, dated Sep. 27, 2018, with English Translation, 23 pages.
Search Report and Written Opinion issued in parallel Brazilian Application No. BR112017012490-4, dated Jul. 3, 2019 with English Translation, 7 pages.

* cited by examiner

SUITCASE

CROSS-REFERENCE TO RELATED APPLICATIONS

This application is a National Phase Patent Application of International Patent Application Number PCT/EP2015/077347, filed on Nov. 23, 2015, which claims priority of German patent application no. DE 10 2014 118 452.1 filed Dec. 11, 2014, the disclosures of which are hereby incorporated herein by reference.

FIELD OF THE INVENTION

The invention relates to a suitcase, a method for handling suitcases and an arrangement.

TECHNOLOGICAL BACKGROUND

For particular purposes of application, it is desirable to secure suitcases with one another for the transportation. Different solutions exist for this purpose. On the one hand, the bottom sides of the suitcases are held to each other, and are latched with each other at the side of the handle via a pivot mechanism, whereby the two suitcases are held one against the other. On the other hand, spring-loaded clamps can be provided at a side of a suitcase, wherein the clamps are actuated by the arrangement of a further suitcase on the already present one, and then the two suitcases latch with each other. The existing latchings and lockings are expensive and error-prone. Furthermore, it is at least in part a disadvantage, that forces which occur are guided away via the lid of the suitcase and a pivot mechanism, whereby these are error-prone.

DE 39 34 760 A1 discloses a suitcase consisting of a first suitcase part and a second suitcase part. Each suitcase part is configured as a unit, which can be handled separately, is independently lockable, and has a respective lid, which is foldable about respective hinges. The two suitcase parts can be detachably connected with each other by two profile rails, which engage with each other. Furthermore, the two suitcase parts can be fixedly connected with each other by locking a lock, which co-operates with a latching part.

DE 42 01 264 A1 discloses two suitcases, each of which has a bottom part and an associated lid, wherein a respective lid is rotatable relative to the respective bottom part by a respective hinge. Each of the suitcases can be used separately, or can be integrated to form a unitarily transportable unit. For this purpose, the two suitcases can be put one upon the other, such that a stack is created. In order to ensure a correct relative position between the suitcases during the stacking, inserting-centering-means (in the form of pedestals and lid recesses co-operating with the former) are provided at the bottom of the bottom part and at the top of the lid, which are complementary relative to each other, and which are detachably insertable into each other in the stacking direction. For providing stability to the stack of suitcases, connection means are fixed at a bottom part of the respective suitcase, which connection means enable a detachable, fixed connection between the suitcases standing one upon the other.

DE 199 00 361 A1 discloses a container arrangement comprising a main container, which is similar to a suitcase, and a supplementary container, which is similar to a suitcase, each of which can be used on its own and independently from the other, but which can also be connected to a unit, which is transportable as a whole. The main container and/or the supplementary container each have a box-like bottom part and a lid part, which closes the opening pointing upwards of the main part, wherein the parts are pivotable relative to each other for uncovering a respective inner space for accommodating products. The assembled supplementary and main containers can be releasably fixedly coupled with each other by a co-operation of first connection means provided at the main container (which means may be implemented pivotably) with second connection means provided at the supplementary container, in order to be transferred between a coupling position having mutually engaged connection means and a release position, having the coupling means without engagement. Position securing means in the form of protrusions and recesses, which are provided at a base surface of the supplementary container and at a mounting surface of the main container, and which are complementary to each other, may be provided for preventing a displacing.

DE 20 2009 018 589 U1 discloses a container, which can be stacked with other containers of its type one upon the other in a vertical stacking direction. The container has a box-shaped bottom part and a lid, which closes an opening of the bottom part, and which is supported rotatably at the bottom part by pivot means. By a coupling device and an engagement device it is possible to couple suitcase-like containers, which are put one upon the other, releasably with each other such that the container arrangement consisting of the plural containers can be handled as a unit. The coupling device has a coupling means, which is supported at the lid and is movable relative to the lid, in the form of a pivot bolt, wherein the lid can be rotated in a coupling position or in a closing position. In the coupling position, the coupling means is at the same time in a coupling engagement with the bottom parts of both containers sitting on top of each other, such that the two bottom parts can no longer be moved relative to each other in the stacking direction, and thus a lifting of the upper container from the lower container is prevented. On the contrary, in the closing position, the lid is non-liftably locked with respect to the bottom part by the coupling means, such that in the closing position, a further container can be put on, and can also be taken off without hindrance from, an associated container. The engaging device is formed by a first engagement structure arranged at an upper side of a container in the form of engagement recesses, and by a second engagement structure arranged at a bottom side of the container in the form of engagement protrusions. If the engagement structures are in engagement with each other, the containers, which are set one upon the other, cannot be shifted relative to each other and are protected partially from a taking off in the stacking direction by an engaging-behind.

DE 20 2010 000 218 U1 discloses a stackable suitcase having a shell-shaped bottom part, which is open upwards, and a shell-shaped upper part, which is opened downwards, and which is hinged rotatably to the bottom part by a hinge. The suitcase has first connection elements provided in the corners of the suitcase and second connection elements provided at side surfaces of the suitcase, so as to be able to slip-proofly stack plural similar suitcases along different spatial directions and in different orientations. Complementary first connection elements may enable to stack the suitcase and a similar second suitcase one upon the other in different orientations.

Complementary second connection elements may enable to stack the suitcase and a similar second suitcase over each one of the side surfaces and in different orientations.

U.S. Pat. No. 7,219,969 B2 discloses a storage container having a drawer and a drawer housing, wherein an accommodating space for accommodating articles is formed and the drawers are divided in partitions. The drawer is mounted displaceably to the drawer housing. Furthermore, the drawer housing can be pivoted with respect to the drawer. Plural storing containers can be stacked on top of each other, and are individually accessible still then. For the stacking, an upper coupling of a lower storage container and a lower coupling of an upper storage container are transformed in a locking state. If this locking state is overcome, the storage containers can be taken off from each other.

U.S. Pat. No. 7,523,827 B2 discloses a stacked arrangement of sterilization housings consisting of a plurality of stacked sterilization housings. Each sterilization housing has a telescopic drawer and a pivotable lid. Handle pieces are formed at the side walls of the sterilization housings, which co-operate with pockets having cavities, so as to lock plural sterilization housings to each other in the stacked state.

US 2010/0 147 642 A1 discloses a lockable housing system consisting of a base housing and an upper housing. The base housing has a luggage receptacle and a lid, which together form a luggage compartment. Receiving ends provided at an end of linear recesses of the lid of the base housing are formed for receiving projecting ends of rails of the upper housing. Retainers are formed at the opposite end of the lid of the base housing as a part of an interlocking device, which further comprises a hook provided at the upper housing.

U.S. Pat. No. 4,122,925 A discloses a combined luggage structure consisting of a suitcase and a plugging housing, both of which can accommodate luggage. The suitcase and the plugging housing can selectively be used separately from each other, or in combination with each other. The suitcase, which can be opened by a hinge, and which can be locked in a closed state by an interlocking device, has a recess, which is defined by side walls, and which is configured to accommodate the plugging housing. For accommodating, the plugging housing is inserted into the recess of the suitcase such that rails provided at the side walls of the suitcase and corresponding channels provided at side walls of the plugging housing slide along each other and come in engagement with each other.

U.S. Pat. No. 5,699,925 A discloses a portable container for forming a stackable, locked arrangement with other containers. The container has a hollow body and a lid, which are connected pivotably with each other by a hinge. An upper wall of the lid has a spring, and a lower wall of the hollow body has a notch for taking the spring in engagement, if the two containers are stacked one upon the other.

EP 2 020 188 A1 discloses a suitcase-like container having a box-shaped lower part and an open top side, to which a container lid is associated, by which the lower part can be closed or opened by tilting. An accommodating space in the interior of the container is divided in variable compartments.

Plural containers are stackable one upon the other, and are fixedly detachably connectable with each other in the stacked, one upon the other state, such that the stacked containers form a fixedly joint unit. For this purpose, each container has plural upper connecting means, which are arranged distributedly along the circumference at its outer side in the upper portion of a container, and which are arranged adjustably in respect of their height, and has plural lower connection means, which are arranged correspondingly distributedly in its lower portion, and which are implemented as latching studs.

SUMMARY OF THE INVENTION

There may be need to provide a suitcase, which can be mounted in a user-friendly manner to another body, in particular a suitcase.

Embodiment examples of the present invention are provided in the appended independent patent claims. Further embodiment examples are shown in the dependent claims.

According to an exemplary embodiment example of the present invention, there is established a suitcase for transporting goods to be transported, wherein the suitcase may have a corpus; a lid, which may be connected, or may be connectable, to the corpus; and coupling structures, which may be provided at the corpus and/or at the lid; wherein in a closed state, an accommodating space for accommodating goods to be transported may be formed between the corpus and the lid inaccessible from the outside, wherein in an open state, the accommodating space may be accessible from the outside, and wherein the coupling structures may be configured such that the suitcase and another suitcase (in particular a similar other suitcase) having coupling structures (in particular similar coupling structures) may be, by the coupling structures (in particular of both suitcases), one upon the other, selectively: vertically detachably and protected against displacement stackable, or vertically non-detachably coupleable with each other.

According to a further exemplary embodiment example of the present invention, there is provided an arrangement, which has a suitcase having the above-described features, and an additional body, which has coupling structures, wherein the suitcase and the additional body are configured such that the coupling structures of the suitcase and the coupling structures of the additional body can be brought in operative connection with each other, such that the suitcase and the additional body are selectively: vertically detachably and protected against displacement stackable, or vertically non-detachably coupleable with each other.

According to a further exemplary embodiment example of the present invention, there is provided a method for handling a suitcase for transporting goods to be transported, wherein in the method, a corpus and a lid, which may be connected, or may be connectable, to the corpus, may be handled, so as to transform the suitcase between a closed state, in which an accommodating space for accommodating goods to be transported may be formed between the corpus and the lid inaccessibly from the outside, and an open state, in which the accommodating space may be accessible from the outside, and coupling structures, which may be provided at the corpus and/or at the lid, may be handled, so as, by the coupling structures, to selectively, one upon the other: possibly stack the suitcase and another suitcase (in particular a similar suitcase, preferably having other coupling structures corresponding to the coupling structures of the suitcase) vertically detachably and protected against displacement, or to possibly couple the suitcase and the other suitcase vertically non-detachably to each other.

According to an exemplary embodiment example of the invention, thus, a suitcase for transporting goods to be transported is provided, which can easily be handled by a user and which can be brought in different connection states with other bodies and/or suitcases in an intuitive manner. A user may also bring a suitcase, which may be in one of these connection states, back again in another connection state, or in a separated state, by a simple handling. Thus, the suitcase, in combination with another similar or like suitcase or another corresponding body, may be selectively stackable or coupleable, wherein an upper one of the two suitcases, which may be coupled to each other stackably and/or coupleably, can, in this state, still be transformable between the open state and the closed state. Thus, a user can obtain access to the interior space of this upper suitcase of the arrangement even in the coupled or stacked state.

In the vertically detachable, but protected against displacement in a horizontal plane stacked state, it may be possible that a user separates the upper suitcase of the suitcases, which may be connected to each other, by a mere vertical lifting from the other suitcase. On the other hand, in this state, it may be made impossible that one suitcase may be displaced (or shifted) horizontally with respect to the other suitcase. Thus, in this operating state, the suitcases may be slip-proofly secured with respect to each other, but may be separable from each other immediately by one single movement of the hand. This operating state may thus be suitable for stacking the two suitcases temporarily.

Alternatively, however, the suitcases may also be coupleable with each other vertically non-detachably, i.e. connected with each other, such that the separation of the two suitcases may not be enabled in the case of a mere vertical lifting off movement. A separation of the two suitcases from each other may be, in this operating state, only enabled by a relative displacement (or shifting) of the two suitcases along a horizontal displacement direction. Furthermore, it may be possible that, starting from this connection state, which may be non-detachably coupled by exercising a purely vertical force, the coupled suitcases/bodies may be immobilized also in a horizontal plane, by exerting for example a fixing force, which may act perpendicular to a displacement direction of the suitcases, for example by a latching connection for then also horizontally protected against displacement coupling of the two suitcases. According to a preferred embodiment example of the present invention, a protection against displacement holding function (for example effected by rails) of the suitcases against each other may be formed separately from a holding and latching function of the suitcases to each other, which may make a displacement temporarily impossible, such that the suitcases can be held stably against each other without latching them with each other. It may further be possible to stack, to couple, and/or to latch suitcases having different depths with each other. For holding two suitcases (for example a suitcase and another body, for example a further suitcase or a storage box) against each other, they may be provided for example with rails and/or rail segments (provided in particular at the side walls between the bottom side and the handle side), which may engage with each other. For being capable to latch the suitcases with each other, a latching provision can be provided, in particular at a handle side, e.g. in the form of latching projections, which can engage from the upper suitcase in the lower suitcase, so as to possibly prevent a relative displacement along the rails.

Additional exemplary embodiment examples of the suitcase, of the method, and of the arrangement are described in the following.

According to an exemplary embodiment example, a part of the coupling structures may contribute both to the vertically detachably protected against displacement stacking and to the vertically non-detachably coupling with each other. Stated differently, a part of the coupling structures may be embodied as physical bodies, which may be shaped such that they contribute to the formation of the respective connection state both in the vertically removably displacement-securedly stacked state and in the vertically irremovably coupled with each other state, and may co-operate with a respective corresponding structural feature of the respective other suitcase. Thus, the suitcase can be formed simply and compactly, and can be used in very different operating states possibly at the same time.

According to an exemplary embodiment example, the coupling structures may be configured such that the suitcase and the other suitcase may be, in the one upon the other vertically detachably coupled with each other state, by the coupling structures, selectively displaceable relative to each other, or may be protected against displacement relative to each other by actuating the coupling structures. By at least one further coupling structure provided at at least one of the suitcases, preferably by corresponding coupling structures provided at the suitcases, which may be coupled with each other, a third connection state can be defined therewith, which, in the vertically non-detachably coupled state of the two suitcases, additionally may enable a relative displacement of the same with respect to each other (for example by de-activating latching structures), or may make impossible a relative displacement of the same relative to each other (for example by activating latching structures). For reliably securing two suitcases against each other (for example for a car ride), the two suitcases can thus be reversibly locked against each other.

According to an exemplary embodiment example, a coupling direction, along which the suitcase and the other suitcase can be arranged one upon the other for the coupling, and a stacking direction, along which the suitcase and the other suitcase can be arranged one upon the other for the stacking, can be identical. In other words, a coupling direction (along which the suitcases can be arranged one upon the other for the coupling) and a stacking direction (along which the suitcases can be arranged one upon the other for the stacking) of the two suitcases can be the same.

According to an exemplary embodiment example, a part of the coupling structures, which may contribute to the protection against displacement in the one upon the other vertically detachably coupled with each other state, can be configured, and can be activated, independently from another part of the coupling structures, which may contribute to both the vertically detachable protected against displacement stacking and to the vertically non-detachable coupling with each other. By forming a part of the coupling structures, which may couple the two suitcases also horizontally non-detachably during vertical non-detachability, separately from another part of the coupling structures, which may prevent a vertical lifting off (or detaching) in the coupled state, it may be possible for a user to set (or adjust) the connection states of the horizontal protection against displacement or of the horizontal displaceability during temporary vertical non-detachability independently from each other. The structural separation of these coupling structures thus may lead to the possibility for a user to use the two corresponding functions independently from each other.

According to an exemplary embodiment example, a part of the coupling structures, by which the suitcase and the other suitcase or body may be stackable one upon the other vertically detachably protected against displacement, can be implemented in the form of latching cams provided at outer upper-side edge sections of the corpus as well as in the form of latching bases (or latching feet) having lower-side accommodating notches provided at outer lower-side edge sections of the corpus, wherein the accommodating notches may co-operate with the latching cams in the stacked state. Thus, latching cams, which may be arranged at the top at a side wall of the suitcase, can dunk into latching bases, which may be arranged at the bottom at a side wall of another suitcase.

By integrally shaping, or placing, the latching cams and the latching bases at a side on a side wall of the respective suitcase and/or body, it may also be possible to place all the coupling structures, which may be used for the stacking, at only one tilting component of the suitcase (in particular only at the corpus, not on the lid), whereby an actuation of the other tilting component (in particular the lid) may be enabled also in the coupled state of the coupling structures. Stated otherwise, a lid can be tilted or even detached, even if a stacking or a locking with the other suitcase is effected on the corpus. The multi-functional latching cams may provide a functional contribution in different connection states of the suitcase selectively for the protected against displacement stacking or for the protected against detachment coupling.

According to an exemplary embodiment example, a part of the coupling structures, by which the suitcase and the other suitcase may be coupleable with each other one upon the other vertically non-detachably, can be configured in the form of guide rails provided at outer edge sections at the top of the corpus as well as in the form of lower-side coupling projections, which may be provided at outer lower-side edge sections of the corpus and which may co-operate with the guide rails in the coupled state. For possibly making impossible the vertical detaching from each other while enabling a relative displacing with respect to each other, the suitcases can thus be coupled along a rail-type construction provided at the side wall of the respective suitcases. Thus, guide rails (which can be implemented continuously or only section-wisely, i.e. discontinuously) may co-operate with coupling projections, which can engage in a guide opening of the guide rail. A displacement direction may thus be defined, which can be recognized intuitively by a user. By integrally shaping the guide rails and the coupling projections at side walls of the suitcases and/or bodies, in particular only at the corpus of a respective suitcase, the transformability of the corpus-lid-structure between the open state and the closed state may remain possible, even if the two suitcases/bodies are coupled with each other vertically non-detachably.

According to an exemplary embodiment example, the latching cams may form a part of the guide rails, in particular may confine a guide rail to one side. Stated descriptively, the latching cams may confine a part of the guide rails in the mentioned embodiment. Such a guide rail may have an opening, which may be for guiding the coupling projections, and which may be arranged between an upper confinement section and a lower confinement section. One of these two confinement sections can be formed as an elongated and preferably continuous rail, which can co-operate with lateral protrusions of the latching cams, thereby forming the guide notch for guiding the coupling projections. Thereby, a particularly simple implementation of the coupling structures may be achieved, because the latching cams may contribute not only to the stacking function, but also to the vertical displacing of respective suitcases relative to each other.

According to an exemplary embodiment example, the coupling projections may form a part of the latching bases (or latching feet). According to this preferred implementation, the latching bases having their coupling projections may contribute also to the described displacement functionality. In particular, it may be possible to fix the coupling projections at the latching bases laterally and inwardly oriented.

According to an exemplary embodiment example, the latching bases may extend downwards vertically beyond a bottom surface of the corpus, such that the suitcase can be deposited (or is depositable) at the latching bases onto an underground. A main surface of the corpus may thus be protected from a direct contact with the underground, and can thus be protected from contamination and damage. Thus, in this embodiment, the latching bases may contribute also to a standing functionality upon depositing the suitcase on an underlayment.

According to an exemplary embodiment example, a part of the coupling structures, by which the suitcase and the other suitcase may be one upon the other vertically non-detachably protected against displacement coupled with each other state, can be formed in the form of accommodating notches and latching sliders co-operating with the former. In particular, the latching sliders provided at the corpus of the one suitcase can be insertable into the accommodating notches provided at the corpus of the other suitcase. Thus, latching sliders provided at one suitcase and accommodating notches provided at the other suitcase may enable that the two suitcases may be secured against a displacement in the vertically non-liftable from each other state. While the coupling structures for enabling the stacking as well as the coupling structures for enabling the vertically non-detachably displacement in the horizontal plane can be fixed (in particular exclusively) at a common lateral side surface (and/or at two side surfaces that are opposite to each other) of the respective suitcases, accommodating notches and latching sliders may be fixed at another, in particular front-side, side surface of the suitcase. The spatial separation of these coupling structures may indicate to a user in an intuitive manner the functional separation of the functionalities which may be achieved by the respective coupling structures. If a latching slider of one suitcase/body is pulled and/or inserted into an associated accommodating notch of a coupled suitcase/body, namely in the vertical direction, a form-fit, which may prevent a displacement along the guide rails, may be implemented thereby. Then, also a detaching by displacing in the horizontal direction may thus be temporarily made impossible.

According to an exemplary embodiment example, at least a part of the coupling structures may be provided at side surfaces of the corpus. The side surfaces of the corpus may be suited particularly well for the provision of the coupling structures, because a significant surface for providing the coupling structures, which would otherwise remain unused, may be available there. The corpus may be formed shell-shaped (or in the form of a shell) and may form a majority of the accommodating volume in its inner region, whereas the lid may be placed substantially planar on the corpus, so as to possibly close the accommodating space together with the corpus. In this embodiment, the side surfaces of the corpus may be predestinated for the placement of at least a part, preferably of all, of the coupling structures. The lid may remain free from such coupling structures, and may thus still remain manageable independently of a respective connection state of a suitcase in relation to another suitcase/body. According to an exemplary embodiment example, the lid may thus be free from the coupling structures. If all the coupling structures are fixed at the corpus and no coupling structures are fixed at the lid, the lid may be capable to transform the suitcase between the closed state and the open state even in the stacked or coupled state. A user may thus obtain access to the accommodating space, if he/she takes off and/or tilts away the lid from the corpus of the upper suitcase in the stacked or coupled state of the two suitcases. Coupling structures provided at the lid would impair this independent handling (or management) of the lid in the coupled or stacked state, and may thus be avoided according to the described preferred embodiment example.

According to an exemplary embodiment example, the suitcase may be configured to be selectively stackable or coupleable with a similar suitcase having, selectively, a same or a different depth. According to a first implementation, two identical suitcases may thus be coupled with each other. However, it may be possible to connect with each other two suitcases, which may be formed similarly, but which have different dimensions in respect of the depth in the shifting direction. Thereby, the functionality of the suitcases may be increased further, and the flexibility in the combination of different suitcases may be improved further.

According to an exemplary embodiment example, the suitcase may further have handle recesses provided at side surfaces of the corpus, which may be opposite to each other. Regions of the side surfaces of the corpus, which regions may be free from coupling structures, may thus be used for fixing, or integrally shaping, handle recesses, at which a user may handle the suitcase for example for the vertically stacking, but also for the vertically non-detachably coupling. Thereby, surface regions at the side walls of the corpus, which may remain free from coupling structures, may be efficiently used without having to increase the weight or the size of the suitcase.

According to an exemplary embodiment example, the suitcase may further have a locking device (which may for example comprise a key and an associated lock) for locking the lid to the corpus in the closed state. A locking of the suitcase, for example as an anti-theft protection, may be possible by actuating a locking device having co-operating components provided at the lid and at the corpus, independently from the function(s) of the coupling structures.

According to an exemplary embodiment example, the suitcase may further have a, particularly substantially U-shaped, handle provided at a side surface of the corpus, which handle may be tiltable between a state folded to the side surface of the corpus and a state folded away from the side surface. For a user being able to carry the suitcase in the non-stacked and the non-coupled state, the user may hold the handle provided at the, preferably front-side, side surface of the suitcase. For enabling a space-saving transportation of the suitcase, the handle may selectively also be folded to the suitcase, so as to not, or only insignificantly, project with respect to the suitcase in an inactive state. It may also be possible to exercise on the handle a mechanical pre-load (embodied for example by a spring mechanism or a magnetic force) to the effect that the handle may be folded to the side wall of the suitcase in the non-actuated state. Only if a user possibly exercises a folding away force, or possibly carries the suitcase, such that the two-dimensional outer walls of the lid and of the corpus may be oriented vertically, the handle may remain in the folded away state by the own weight of the suitcase.

According to an exemplary embodiment example, the handle may have a hard component for stabilizing and a soft component for touching the handle by a user when carrying the suitcase. The hard component may render stability to the handle and may configure the handle rigidly as a whole as well as enable a supporting of the handle at the corpus. The soft component may prevent that the handle cuts in upon carrying by a user, and may distribute the carrying weight of the suitcase homogeneously over a larger contact area of a hand of the user.

According to an exemplary embodiment example, the suitcase may have a hinge, which may tiltably connect the corpus and the lid with each other, and which may be configured to be capable to fold the suitcase between the closed state and the open state. By the provision of a hinge, the lid and the corpus may be folded relatively to each other when transforming the suitcase between the closed state and the open state. However, alternatively to this, a configuration of the suitcase may also be possible to the effect that the lid and the corpus may be displaced longitudinally with respect to each other for transforming the suitcase between the closed state and the open state, or the lid may be taken off completely from the corpus.

According to an exemplary embodiment example, the latching bases (or latching feet) and the hinge may be configured such that the hinge may be spaced non-contactingly with respect to the underground. If the hinge is sufficiently spaced from the latching bases, the described structural arrangement of the components may result in that, when depositing the suitcase onto the underground and when folding open the lid with respect to the corpus, the hinge may never lie on the bottom and/or on the underground, and may thus be protected from a mechanical damage.

According to an exemplary embodiment example, the corpus may be configured to be detachable from the lid, so as to possibly be applicable as a drawer in the detached state. According to this implementation, the suitcase may be accommodated at least temporarily in, for example, a shelf or a movable workshop, and may serve there as a drawer. If a user desires so, he may pull, take out, or displace outwardly the suitcase without lid from the shelf, may mount the lid, and may handle the suitcase in a usual manner.

According to an exemplary embodiment example, accommodating structures (for example elevated guide bars) may be formed at an inner side of the corpus and/or of the lid for accommodating (or receiving) at least one accommodating container. Such accommodating structures may be formed as bottom ribs of an otherwise plane inner surface of the corpus and/or of the lid, such that the accommodating container having a corresponding size and shape may be accommodated in surface regions of the corpus and/or of the lid, which regions may be free from these accommodating structures and may be confined thereby, and may then, in the closed state of the suitcase, be protected by the accommodating structures from a displacement or also from a getting lost of fill goods or goods to be transported from the accommodating container. For example, the accommodating structures may have, for example, line and column accommodating structures, which may be arranged, for example, vertically to each other, so as to possibly form rectangular accommodating areas in a matrix-shaped arrangement. It may also be possible to form further accommodating structures in intersection regions, for example an annular closed accommodating structure provided in some of the intersecting regions, or even in each intersection region, so as to possibly confine, for example, four accommodating surfaces around such an intersection region. The accommodating structures on the lid and on the corpus may be formed in correspondence to the formation of the bottom surfaces and the lid surfaces of the accommodating containers.

According to an exemplary embodiment example, the suitcase may have the at least one accommodating container, which may be accommodated or may be accommodatable reversibly (that is detachably) at the inner side.

One or more accommodating containers may thus be arranged in the interior of the suitcase or may be removed therefrom. Such accommodating containers may, for example, be assortment boxes for accommodating screws, rawlplugs or nails. Even tools may be accomplished in the interior of the suitcase, for example directly in accommodating structures that may be accordingly configured. For example, it may be possible that such an assortment box may be a container, which may be open at the top, the bottom of which may be arranged between accommodating structures of the corpus and the open upper side of which may be protected (for example form-fittedly) by accommodating structures provided at the lid in the closed state of the suitcase from a dropping (or falling) out of fill goods from the accommodating container.

According to an exemplary embodiment example, the accommodating structures and the corresponding outer structures of the accommodating container may be fitted with respect to each other such that an accommodation of the at least one accommodating container at the inner surface may be enabled in only one predefined orientation and may be made impossible in other orientations. By enabling an accommodation of accommodating containers of a particular bottom shape between accommodating structures of the corpus mechanically in only one particular orientation of the accommodating container relatively to the corpus, it may be ensured that an erroneous misorientation of accommodating containers in respect of the suitcase may be avoided. The user may thus be supported in using the accommodating container and the suitcase in an error-robust and/or efficient manner. A making impossible of a misorientation may be effected, for example, by the purposeful placement of interfering structures on the inner surface of the corpus and/or of the lid, wherein the interfering structures may exclude the placement of an accommodating container in an undesired orientation.

According to an exemplary embodiment example, the accommodating structures of the corpus and/or of the lid, on the one hand, and corresponding outer structures of the accommodating container, on the other hand, may be adapted to each other, such that an accommodation of the at least one accommodating container at the inner surface at variable positions, which may be selected by the user, may be enabled. A regular (or ordered) arrangement of the accommodating structures at the inner surface of the corpus and/or of the lid may flexibly enable a user to possibly place a particular accommodating container at plural different positions (for example, in each intersection region of accommodating structures, which are arranged in a matrix-type manner), and in particular namely protected against a misorientation. Thereby, a high flexibility and an error-robust usage of the suitcase may be combined.

According to an exemplary embodiment example, the accommodating structures and the accommodating container may be adapted with respect to each other, such that the lid, in the closed state, may make impossible a dropping out of fill goods from the accommodating container. According to this embodiment, the accommodating structures may serve not only for the defining of an accommodation position, but also for annularly enclosing containers, which may be open at the top, in the closed state of the suitcase, and thus possibly for preventing a dropping out of fill goods from the one or the plural accommodating containers.

According to an exemplary embodiment example, at least a portion of the lid may be transparent. If the lid of the suitcase is implemented transparently, a user may recognize from the outside, even in the closed state of the suitcase, which accommodating containers, which fill goods or goods to be transported, which tools and/or which other bodies may be located in the suitcase. It may then not be necessary to open the lid with respect to the corpus for this purpose.

According to an exemplary embodiment example, a document holder may be fixed at an inner side of the lid. Such a document holder may be a clamp, at which a user may fix a document (such as for example an operation manual, a leaflet, a catalogue or another document) or also another body. The provision of a document holder may be effected alternatively or in addition to the provision of accommodating structures at the inner side of the lid.

According to an exemplary embodiment example, the corpus and/or the lid may be formed as a die cast component. A realization of the corpus and/or of the lid as a die cast component may enable a cost-efficient manufacture and a light-weight embodiment of the corpus and/or the lid. Thereby, in addition, an integrally shaping of coupling structures, or at least of a portion thereof, may be enabled during the die casting.

According to an exemplary embodiment example, the additional body may be an additional suitcase having the features described above. The arrangement may thus be effected by two similar (identically or differently sized in respect of at least one dimension) suitcases.

According to another exemplary embodiment example, the additional body may be a storage box. Thus, also a combination of a suitcase and a storage box, which may be for example a safekeeping crate (which may, for example, have an access panel) may be possible.

Also other additional bodies may co-operate structurally and functionally with the suitcase, for example a shelf, an assembling device of a motor car, etc.

BRIEF DESCRIPTION OF THE DRAWINGS

In the following, exemplary embodiment examples of the present invention are described in detail with reference to the following figures.

DETAILED DESCRIPTION OF EXEMPLARY EMBODIMENTS

Figure 1:
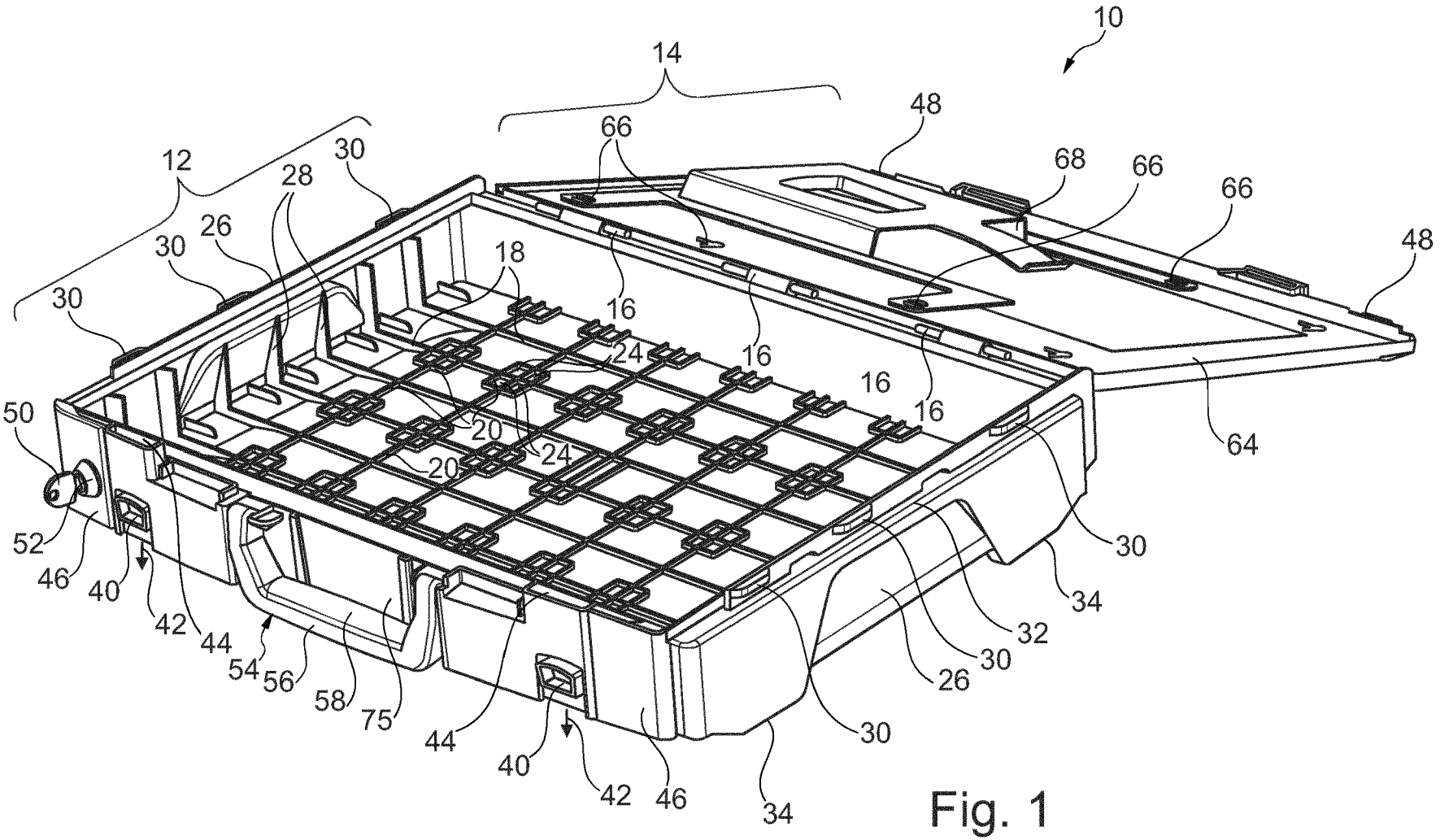
FIG. 1 to FIG. 3 show a suitcase according to an exemplary embodiment example of the invention in an open state.

Similar or like components in different figures are provided with the same reference numerals.

Before exemplary embodiment examples of the invention are described with reference to the figures, some general aspects of the invention shall still be explained.

A suitcase according to an exemplary embodiment example of the invention may have a bottom, which may also be called corpus, and a lid as well as four side walls (which may, for example, form parts of the corpus). Handle recesses for a hand of a user for relocating the suitcase may be arranged on two opposing sides (for example a right side and a left side). For example, two lid latches may be provided at the handle side for latching the lid to the corpus. Alternatively, also two, three or even more handles may be formed at a handle side for carrying the suitcase. The handle may be formed of two components, a hard and a soft component. There may be an abutment, which may prevent a tilting by more than a predefinable angle of for example 120°, alternatively at least 90°. Three (alternatively, at least two) corpus rail sections, which may be formed, for example, as latching cams, may be arranged at the right and at the left side wall at the side of the lid. These may be formed integrally with the corpus, and may have recesses in a lid-side surface. Three (alternatively, at least two) bottom rail sections, which may be formed, for example, as latching bases (or latching feet), may be located at the right and at the left side wall at the side of the bottom. These may be formed integrally with the corpus. They may have recesses in the bottom-side surface (alternatively, projections from the bottom).

For merely putting two suitcases one upon the other (state I), bottom rail sections may be put on corpus rail sections. The handle sides of the suitcases may be aligned with each other in this position.

For holding two suitcases against each other (state II), the bottom rail sections may be put on a running rail provided underneath the corpus rail sections, and the upper suitcase may be displaced (or shifted) backwards relatively to the lower one, up to an abutment. Corpus rails sections and running sections then jointly may form a guide rail. In this state, the cases may be held against each other, however displaceable along the direction of the rails. Handle side surfaces of the suitcases may be preferably aligned with each other in the state II.

For holding two suitcases against each other and for locking them to each other (state III), these may be shifted into each other (as according to state II) and then the suitcase may latche (which may be formed as latching sliders, which may be inserted in corresponding accommodating notches) are actuated, whereby the suitcases may no longer be displaceable relatively to each other. In this state, the suitcases may be held against each other and may be locked to each other.

The states II and III may be realized, if the suitcase having the suitcase bottom possibly lies on an underground, or if the suitcase possibly stands on its bases (or feet). On the side that is opposite to the handle side, the suitcase may have, for example, six knuckle feet or latching feet (alternatively, at least two), on which the suitcase may be deposited. The height of the knuckle feet may be selected such that the hinges of the lid may have no contact to an underground. A lock may be provided at a lid latch for possibly locking the suitcase or the suitcases.

Storage boxes may also be provided with rail sections for holding and for latching, if needed, the storage box to the suitcase. The rail sections may also be formed as continuous rails. However, it may also be possible to form only one rail section as a continuous rail. The corpus without lid may be used as a drawer in a cupboard, a mobile workshop, or an office furnishing. If suitcases having different depths are to be connected with each other, corresponding rail sections may be provided. Bottom rail sections may be formed replaceably with the corpus. The suitcase latches may also be formed as turning elements.

A particularly advantageous aspect of embodiment examples of the invention may be the separation of the functions "laid against each other" (state I), "held against each other" (state II) as well as "held against each other and locked with each other" (state III). All the operating elements and/or the coupling structures may be arranged at the handle side.

Suitcases having different depths, but equal widths, may jointly be brought in the states I, II and III.

Figure 2:
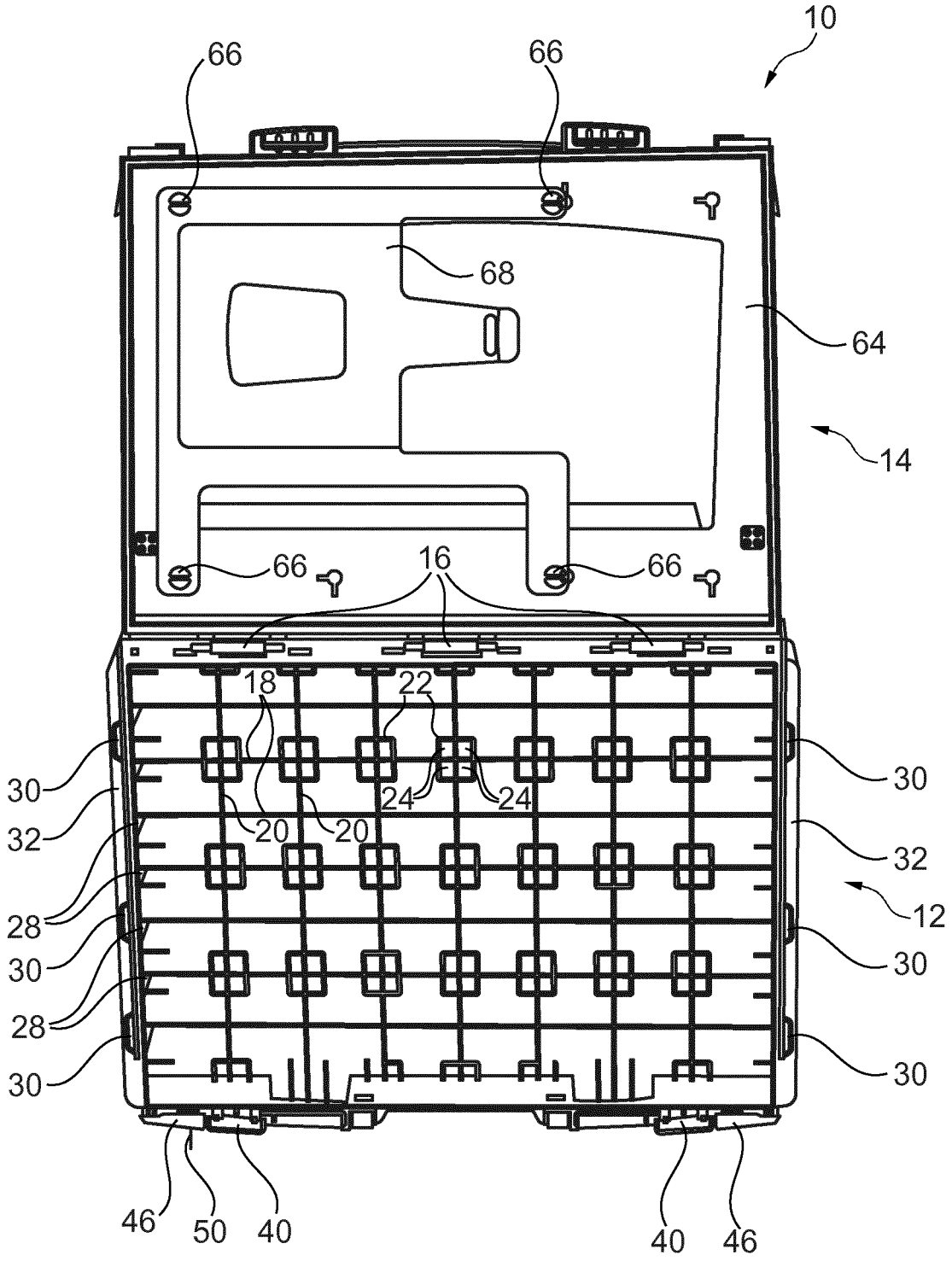
Figure 3:
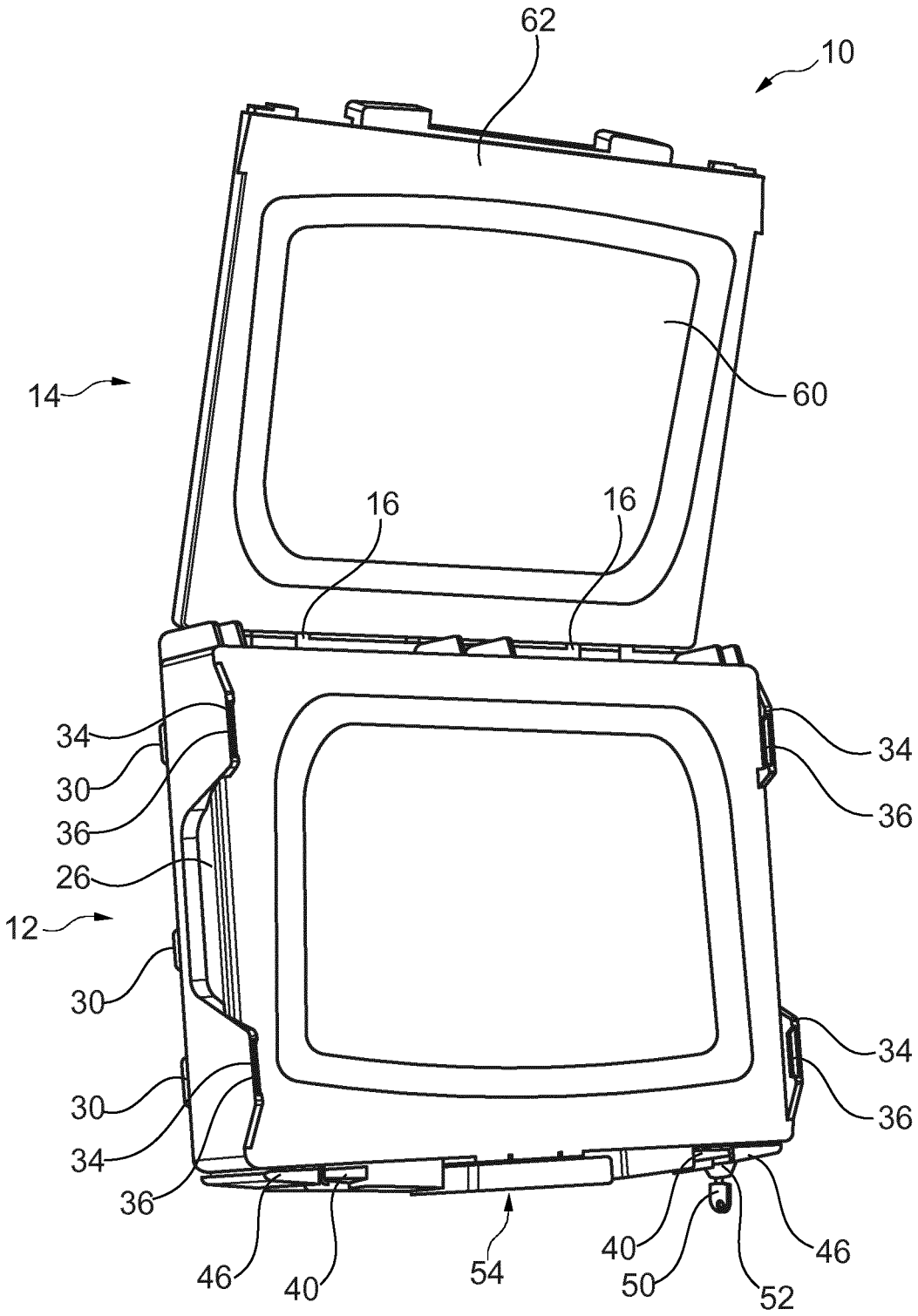
Figure 4:
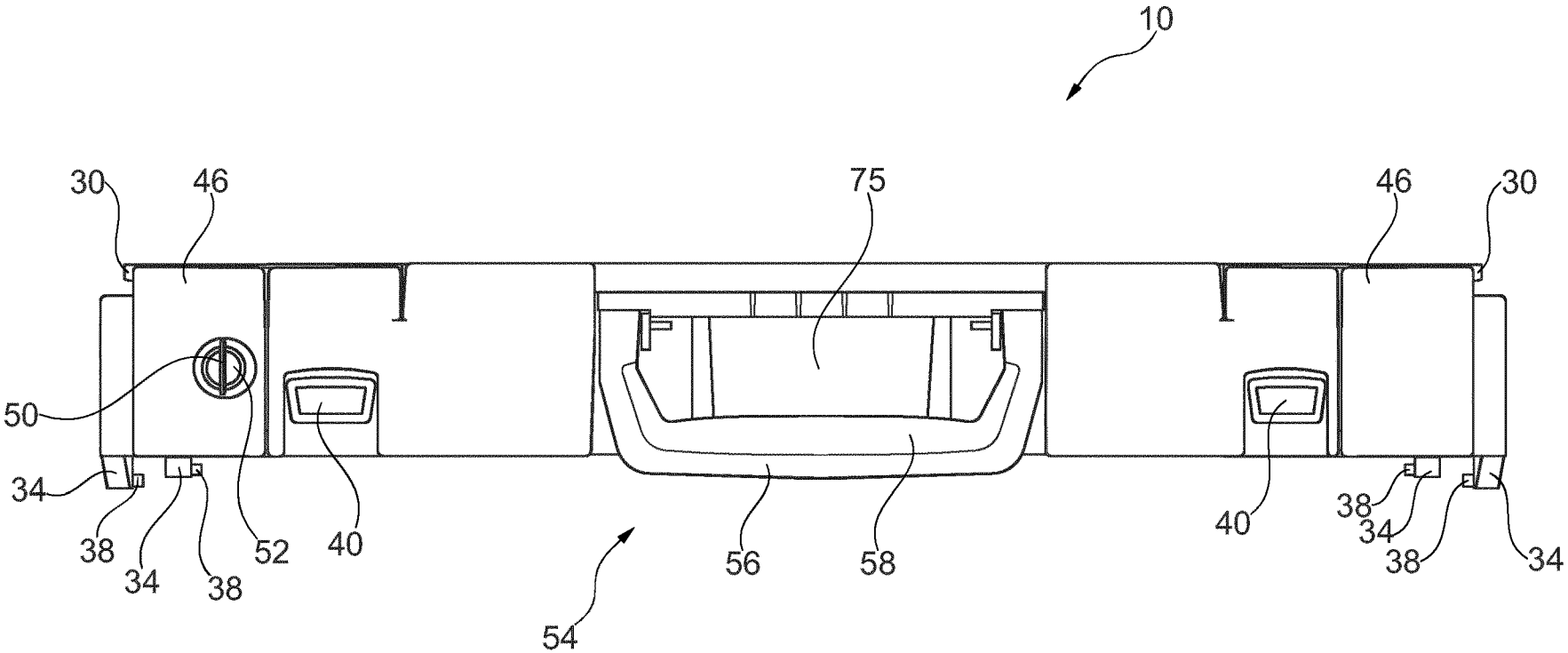
FIG. 4 and FIG. 5 show the suitcase according to FIG. 1 to FIG. 3 in a closed state.
Figure 5:
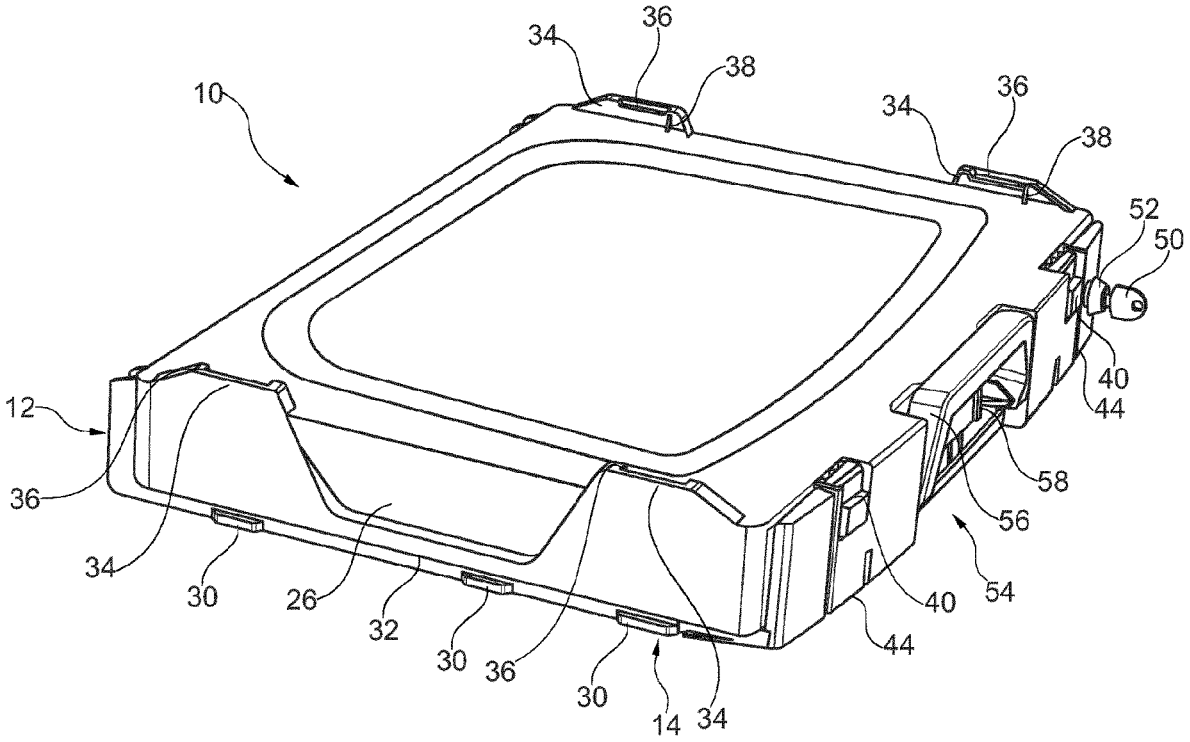
Figure 6:
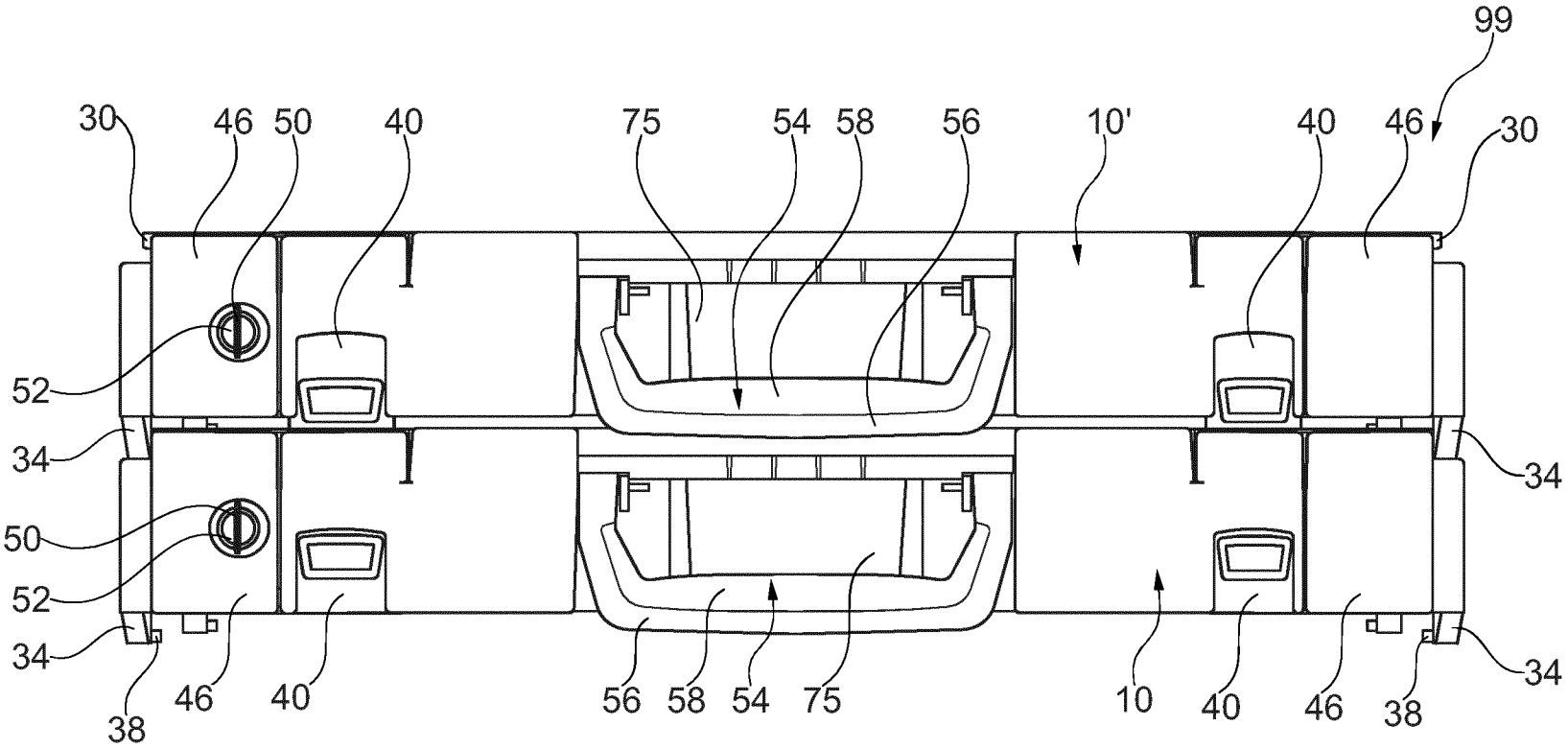
FIG. 6 shows a suitcase, as it is depicted in FIG. 1 to FIG. 5, in a state coupled with another similar suitcase.
Figure 7:
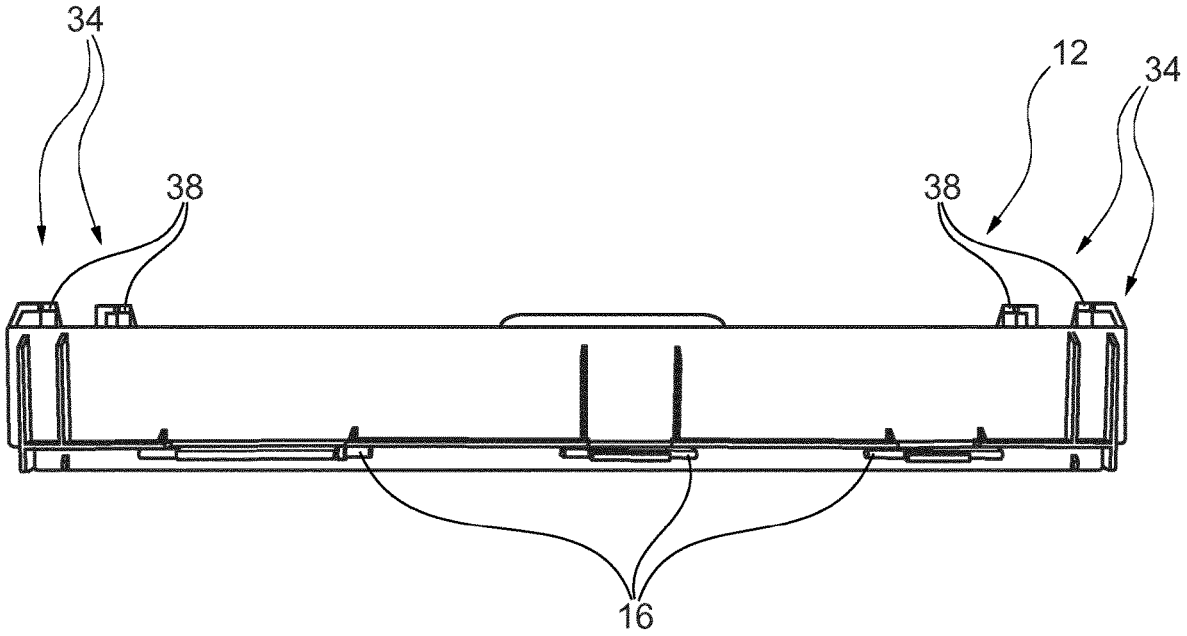
FIG. 7 shows the corpus, which is depicted according to FIG. 1 to FIG. 6, without lid.
Figure 8:
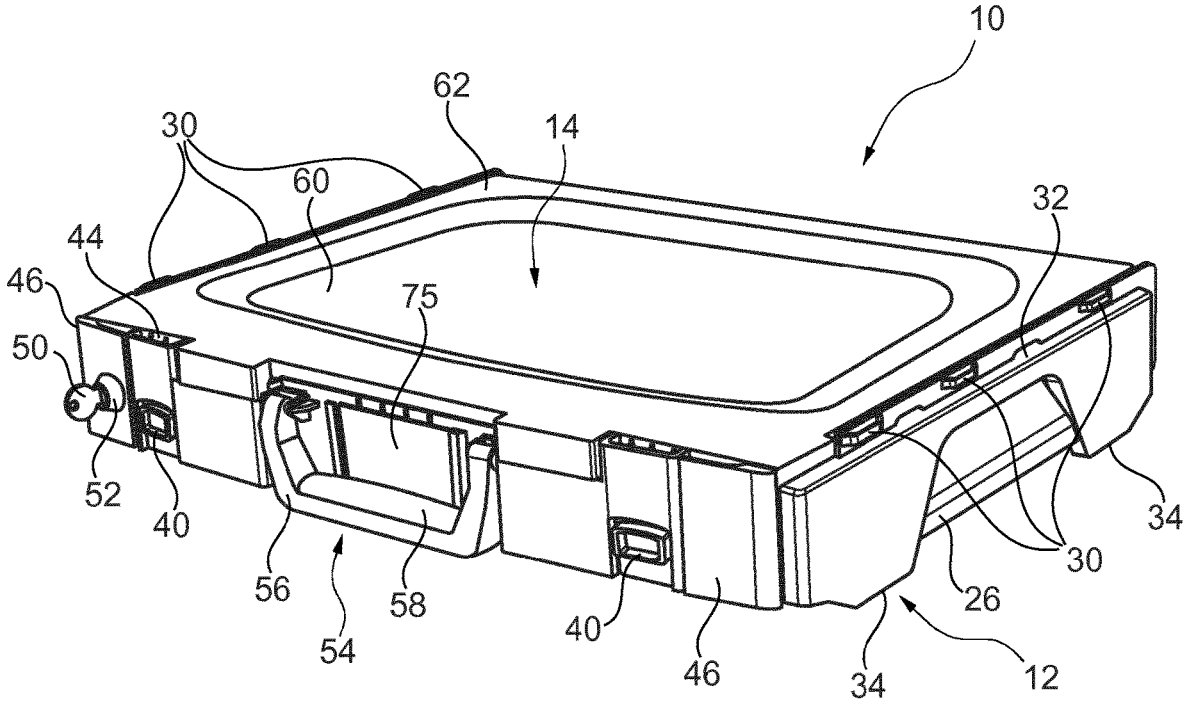
FIG. 8 shows another view of the suitcase according to FIG. 1 to FIG. 6 in the closed state.

FIG. 1, FIG. 2 and FIG. 3 show a suitcase 10 according to an exemplary embodiment example of the invention in an open state. FIG. 4 and FIG. 5 show the suitcase 10 according to FIG. 1 to FIG. 3 in a closed state. FIG. 6 shows a suitcase 10, as is depicted in FIG. 1 to FIG. 5, in a state coupled to another similar suitcase 10'. FIG. 6 thus shows an arrangement 99, which shows the suitcase 10 and the additional similar suitcase 10' in a connection state. FIG. 7 shows a corpus 12, which is depicted according to FIG. 1 to FIG. 6, of the suitcase 10 without lid 14. FIG. 8 shows another view of the suitcase 10 according to FIG. 1 to FIG. 6 in the closed state.

The suitcase 10 may serve for transporting goods to be transported. Such goods to be transported may be accommodated (or received) in the interior of the suitcase loosely or fixedly and/or securedly, and may in particular be accommodated in accommodating containers 80 (not shown in FIG. 1 to FIG. 8, refer to FIG. 9), which in turn may be accommodated safely in the closed state of the suitcase 10 in the interior thereof. Examples of such goods to be transported may be consumption items (such as screws, nails, rawlplugs, bulk material, or liquids) or tools (such as, for example, screwdrivers or bits), etc.

The suitcase 10 may have a corpus 12 and a lid 14 that may be connected, or may be connectable, to the corpus 12. Enforcement ribs 28 for mechanically strengthening the suitcase 10 may be formed at the inner side of the corpus 12. Various coupling structures 30, 32, 34, 36, 38, 40, 44 may be arranged, in the embodiment example shown, exclusively at the corpus 12, and, by contrast, not at the lid 14. In the closed state between the corpus 12 and the lid 14, an accommodating space may be enclosed inaccessibly from the outside for accomodating goods to be transported. In an opening state, the accommodating space may be accessible from the outside, for example for possibly removing goods to be transported from the suitcase 10 or to possibly bring them into the suitcase 10.

The coupling structures 30, 32, 34, 36, 38, 40, 44 may be formed such that the suitcase 10 and the identical other suitcase 10' are, by the coupling structures 30, 32, 34, 36, 38, 40, 44 (which thus may also be provided at the other suitcase 10'), selectively, one upon the other: vertically detachably and horizontally protected against displacement stackable (state I), or vertically non-detachably and horizontally displaceably coupleable with each other (state II). Furthermore, the suitcases 10, 10' may be coupled vertically non-detachably and horizontally non-displaceably coupled with each other (state III). The coupling structures 30, 32, 34, 36, 38, 40, 44, which may perform the stacking (state I) as well as the coupling (state II, state III) of the plural suitcases 10, 10', may be realized exclusively by provisions provided at the respective corpus 12 (refer to the latching cams 30 and accommodating notches 36 of latching bases 34, coupling projections 38 provided at the latching bases 34, a guide rail 30, 32 provided between the latching cams 30, and steps 32 as well as latching sliders 40 and accommodating notches 44 possibly co-operating with each other), but possibly without provisions being provided at the lid 14 for these purposes.

For activating the state I, the other suitcase 10' may be arranged vertically over the suitcase 10, and may subsequently be lowered onto the suitcase 10 such that the accommodating notches 36 at the latching bases 34 of the other suitcase 10' may come in engagement with the latching cams 30 of the suitcase 10. The accommodating notches 36 provided at the latching bases 34 of the other suitcase 10' as well as the latching cams 30 of the suitcase 10 then may provide that the other suitcase 10' may be lifted off vertically from the suitcase 10 (that is, an inverse movement with respect to the stacking movement) at any time, but may be protected against a displaceability in the horizontal plane by the form-fit between the accommodating notches 36 provided at the latching feet 36 of the other suitcase 10' and the latching cams 30 of the suitcase 10.

For activating the state II, the other suitcase 10' may be arranged in the horizontal plane in front of the suitcase 10, and may be vertically lifted slightly with respect to the suitcase 10, such that the coupling projections 38 of the other suitcase 10' may be arranged at a height between the latching cams 30 and the guide rails 30, 32 of the suitcase 10. Then, the activation of the state II may be completed by displacing (or pushing) the other suitcase 10' on (or over) the suitcase 10, such that the coupling projections 38 of the other suitcase 10' may pull (or dunk) in between the latching cams 30 and the guide rails 30, 32 of the suitcase 10. In the state II, a lifting off (or detaching) of the other suitcase 10' from the suitcase 10 may be made impossible by the form-fit between the coupling projections 38, on the one hand, and the latching cams 30 and/or the guide rails 30, 32, on the other hand. At the same time, a separation of the suitcase 10 from the other suitcase 10' may be possible by a horizontal displacing of the other suitcase 10' from the suitcase 10, namely by an inverse displacing movement in comparison to the movement, with which the state II may have been completed.

For possibly activating the state III starting from the state II, in the displaced on (or over) each other state (i.e. in the state of the suitcases 10, 10', wherein the suitcase 10' may be displaced on (or over) the suitcase 10), the latching sliders 40 of the other suitcase 10' may be inserted into the accommodating notches 44 of the suitcase 10 by a vertical displacing movement. In the state III thus possibly completed, also a protection against displacement between the suitcases 10, 10' may be formed, such that then, neither a vertical lifting off nor a horizontal displacing of the suitcases 10, 10' from each other may be possible.

A part of the coupling structures 30, 32, 34, 36, 38, 40, 44 (namely the coupling structures having the reference numerals 30, 34 to 38) may contribute both to the vertically detachably protected against displacement stacking, and to the vertically non-detachably coupling with each other.

As has been described already, the coupling structures 30, 32, 34, 36, 38, 40, 44 may be formed such that the suitcase 10 and the other suitcase 10' are, by the coupling structures 30, 32, 34, 36, 38, 40, 44, in the one upon the other vertically non-detachably coupled with each other state, selectively displaceable with respect to each other (state II, in which coupling structures 40, 44 are not in engagement with each other), or protectable against displacement with respect to each other by actuating the coupling structures 30, 32, 34, 36, 38, 40, 44 (state II, in which coupling structures 40, 44 are in engagement with each other). A part of the coupling structures 30, 32, 34, 36, 38, 40, 44 (namely the coupling structures having the reference numerals 40 and 44), which part, in the one upon the other vertically non-detachably protected against displacement coupled with each other state III, may contribute to the protection against displacement, may be formed, and may be actuated, independently from another part (namely the coupling structures having the reference numerals 30, 32, 34, 36, 38) of the coupling structures 30, 32, 34, 36, 38, 40, 44, which part may contribute to the vertically detachable protected against displacement stacking and/or to the vertically non-detachable coupling with each other (state I and/or state II).

The part of the coupling structures 30, 32, 34, 36, 38, 40, 44, by which the suitcase 10 and the other suitcase 10' may be stackable one upon the other vertically non-detachably protected against displacement, may be formed in the form of latching cams 30 provided at outer upper edge sections of the corpus 12 as well as in the form of latching feet 34 having bottom side accommodating notches 36 provided at outer bottom-side edge sections of the corpus 12, which notches 36 may co-operate with the latching cams 30 in the stacked state.

The part of the coupling structures 30, 32, 34, 36, 38, 40, 44, by which the suitcase 10 and the other suitcase 10' may be coupleable with each other one upon the other vertically non-detachably, may be formed in the form of the guide rails 30, 32 provided at outer upper edge sections of the corpus 12 as well as in the form of bottom side coupling projections 38 provided at outer bottom edge sections of the corpus 12, which projections 38 may co-operate with the guide rails 30, 32 in the coupled state. Thereby, the latching cams 30 may form a part of the guide rails 30, 32, and the coupling projections 38 may form a part of the latching bases (or latching feet) 34. The latching bases 34 may extend downwards vertically beyond a bottom surface of the corpus 12 (see FIG. 4), such that the suitcase 10 may be deposited onto an underground by the latching bases 34.

The part of the coupling structures 30, 32, 34, 36, 38, 40, 44, by which the suitcase 10 and the other suitcase 10' may be protectable against displacement with respect to each other in the one upon the other vertically non-detachably coupled with each other state (state III), may be formed in the form of accommodating notches 44 and the latching sliders 40 possibly co-operating with the former. As is indicated by an arrow 42 in FIG. 1, the latching sliders 40 provided at the corpus 12 of the other suitcase 10' may be insertable into the accommodating notches 40 provided at the corpus 12 of the suitcase 10 (if the other suitcase 10' is arranged above the suitcase 10, as in FIG. 6), or reversely (if the suitcase 10 is arranged above the other suitcase 10').

All the coupling structures 30, 32, 34, 36, 38, 40, 44 may be provided at side surfaces of the corpus 12 (refer, for example to FIG. 1). By contrast to this, the lid 14 may be free from coupling structures 30, 32, 34, 36, 38, 40, 44.

The suitcase 10 further may have grasp recesses 26 in the form of recesses provided at side surfaces of the corpus 12, which may be opposite to each other.

Furthermore, a locking device 46, 48, 50, 52 may be provided for locking the lid 14 to the corpus 12 in the closed state. In the closed state of the suitcase 10, a locking with a counterpart 48 of the lid 14 may be effected by a key 50 in a turning lock 52 in an accommodating element 46 of the corpus 12 in the closed state of the suitcase 10. If the lid 14 is tilted (by a hinge 16, which is described in detail below), for closing the interior of the corpus 12, then, locking elements of the turning lock 52 provided at the corpus 12 may latch with the counterpart 48 provided at the lid 14. The turning lock 52 provided at the corpus 12, which may be activated by the retractable key 50, may comprise a swivelling clamp, which may pulls into the counterpart 48 provided at the lid 14.

A handle 54 may be fixed in a recess provided at a side surface of the corpus 12, which may be on the top in a carrying state, and may be tiltable between a state folded to the side surface of the corpus 12 (see FIG. 1) and a state folded away from the side surface. A transition between these two states may be effected by the user by handling the handle 54. The handle 54 may be formed of a hard component 56 for stabilizing and supporting the handle 54 and of a soft component 58 for a comfortable touching of the suitcase 10 by a user when carrying the suitcase 10. The handle 54 provided at the corpus 12 may be folded to the latter, and may remain there in a compact position by the effect of a latching cam, which may latch the handle 54 in the folded-in state. A label field 75 may be provided in the region of the handle 54, into which label field a marking carrier, which may, for example, be indicative for the contents of the suitcase 10, may be inserted.

The suitcase 10 further may have a hinge 16, which may foldably connect the corpus 12 and the lid 14 to each other, and which may be configured to be capable to fold the suitcase 10 between the closed state and the open state. The latching bases 34 and the hinge 16 may be adapted and positioned structurally with respect to each other such that the hinge 16 may remain non-contactingly at a distance with respect to the underground, if the suitcase 10 lies on the underground by the latching bases 34.

As can be recognized in FIG. 1, a document holder 68 may be fixed at an inner side of the lid 14, by which document holder documents, which are not shown in FIG. 1, may be clamped temporarily and may thus be attached during the transportation.

Both the corpus 12 and the lid 14 may be formed, from the manufacturing standpoint, simply as a die cast component. Subsequently, further components (for example, the latching slider 40 at the corpus 12, or the document holder 68 at the lid 14) may be fixed to the respective die cast component.

The suitcases 10, 10' may also be configured for receiving assortment boxes 80 (refer to FIG. 9), in which, for example, tool materials, such as screws, rawlplugs or others, may be accommodated. This is described in more detail below with reference to the embodiment example according to FIG. 9 and FIG. 10. In the closed state of the respective suitcases 10, 10', the assortment boxes 80 may be secured inaccessibly for a user in the interior of the respective suitcases 10, 10', whereas a user may access the assortment boxes 80 in the open state of the respective suitcase 10, 10'.

As is shown in FIG. 1 and FIG. 2, longitudinal bars 18 and transverse bars 20, which may intersect each other crosswisely, may project in an elevated manner above a plane underlayment at an inner side of the corpus 12. Frames 22, which may be non-square-shaped, which may be rectangular, and which may project in an elevated manner, may be fixed in the intersection regions of the longitudinal bars 18 and the transverse bars 20, wherein the frames 22 may form, jointly with the longitudinal bars 18 and the transverse bars 20, in each intersection region, four non-square-shaped rectangular accommodating recesses 24 for accommodating bases (or feet) 86 of assortment boxes 80 and/or 80', wherein the bases 86 may be substantially shaped inversely to the accommodating recesses 24 (compare FIG. 9). Adjacent accommodating recesses 24 may have a different spacing in the longitudinal and the transverse directions. On the inner surface of the shell-shaped corpus 12, which may define the major portion of the accommodating volume, accommodating structures (see reference numerals 18, 20) may be integrally formed as elevated ribs with respect to the plane base surface in a line-wise and a column-wise manner. This may be effected, for example, in the framework of a die casting process, by which the corpus 12 may be manufactured. Additional accommodating structures (see reference numeral 22) may provide for defining rectangular non-square-shaped accommodating areas 24 for accommodating accommodating containers, which are not shown in FIG. 1, at variable positions, however, respectively, only in one desired orientation.

The arrangement of the accommodating recesses 24 may be largely equidistant, and may be symmetrical in the direction of lines and columns. This equidistance and/or symmetry may be broken, however, in a central region, because there, a range of accommodating recesses 24 may have a geometry, which may deviate from the other accommodating recesses 24, for production-oriented reasons (see FIG. 1 and FIG. 2).

FIG. 1 to FIG. 8 show an embodiment example of the suitcase 10, in which, for example, also a large tool can be accommodated in the accommodating space of the corpus 12, and then the suitcase 10 can be closed.

An outer side of the lid 14 may be formed with a central recess 60, which may be confined circumferentially by an annular protrusion 62. For obtaining a plane surface at the inner side of the lid 14, an annular recess at the inner side of the lid 14, which annular recess may correspond to the annular protrusion 62, may be covered with an annular passepartout 64, which may be ultrasonically welded circumferentially to the lid 14. The document holder 68, which may be formed of plastic, and which may be for clampingly attaching documents, may be mounted to the passepartout 64 by plastic clips 66.

FIG. 2 shows a top view of the suitcase 10 according to FIG. 1, and enables recognizing that the coupling structures may extend in part laterally beyond the respective side wall of the corpus 12.

FIG. 3 shows the suitcase 10 according to FIG. 1 and FIG. 2 in an open state, but from an outer side. Also in FIG. 3, it can be recognized, how the different coupling structures may be formed at side surfaces of the corpus 12.

FIG. 4 shows a front side of the suitcase 10 in the closed state, in which the handle 54 may be folded to a side wall arranged at the front side. Also, the coupling projections 38, which may project inwardly from a bottom side of the latching bases 34, can be recognized well, wherein the coupling notches 38 may extend inwardly so as to be capable to possibly engage between latching cams 30 and guide rails of a lower suitcase that is not shown in FIG. 4.

FIG. 5 shows a stereoscopic view of the suitcase 10 in the closed state. The accommodating recesses 36 provided at the bottom side of the latching bases 34, which may be confined laterally by a protrusion, which may ensure a protection against displacement in the horizontal plane, can be recognized well. The coupling structures 38 may be formed as hollow profiles, and thus light-weight and compatible with die casting. The latching cams 30 may be formed and dimensioned so as to possibly be capable to engage in the accommodating notches 36 of the latching bases 34.

FIG. 7 shows the corpus 12 without lid 14, and enables recognizing that all the coupling structures may be provided at the corpus 12.

In FIG. 8, the suitcase 10 is shown in the closed state, and the figure enables recognizing particularly well the latching cams 30 and a corresponding shaping of the side wall for defining the guide rails 30, 32.

Figure 9:
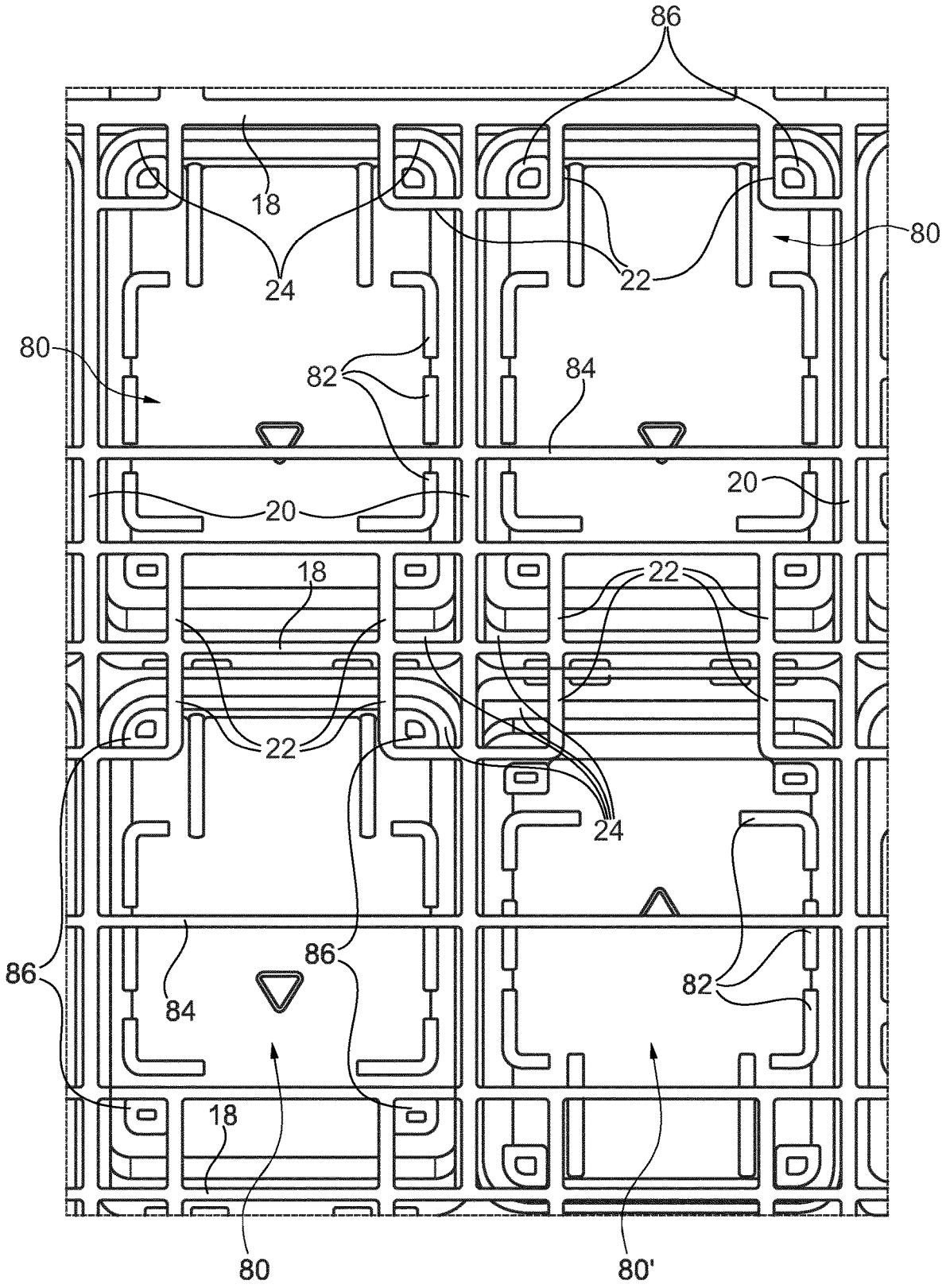
FIG. 9 shows accommodating structures of a suitcase according to an exemplary embodiment of the example in co-operation with corresponding accommodating structures of assortment boxes accommodated in the suitcase.

FIG. 9 shows an implementation of the inner-sided bottom surface of the corpus 12 of a suitcase 10 according to another exemplary embodiment example of the invention, wherein the bottom surface may have accommodating containers 80 possibly being accommodated therein. The accommodating containers 80 each may have four bases (or feet) 86, which may be inserted into rectangular accommodating recesses 24, which may be formed between the accommodating structures 18, 20, 22. Additional interfering (or disturbing) structures 84 in the form of elevated ribs provided at the inner-side bottom surface of the corpus 12 may prevent a misarrangement of the accommodating containers 80 at the corpus 12, because the interfering structures 84 may exclude a tilt-free accommodation of the accommodating containers 80 in the accommodating structures (see reference numerals 18, 20, 22) in the case of an erroneous orientation of one of the accommodating containers 80. The accommodating structures having the reference numerals 18, 20, 22, 84 may co-operate with corresponding bottom-side accommodating structures 82 of assortment boxes 80 which may be incorporated in the suitcase 10. The accommodating containers 80 may be reversibly accommodatable on the inner side of the suitcase 10, i.e. they may be put on and/or be relocated in a user-defined manner. The accommodating structures may have the reference numerals 18, 20, 22 and the corresponding outside accommodating structures 82 of the accommodating container 80, which may be, for example, open at the top, may be adapted (or fitted) with respect to each other such that an accommodation of the at least one accommodating container 80 at the inner surface may be enabled only in one predefined orientation and may be made impossible in other orientations. This may be effected by the interfering structures 84 provided at the corpus 12 in combination with the accommodating structures 82 of the assortment boxes 80. The accommodating structures having the reference numerals 18, 20, 22 and corresponding accommodating structures 82 of the accommodating container 80 may, however, be adapted with respect to each other, such that an accommodation of the at least one accommodating container 80 may be enabled at the inner surface at variable positions, which may be selectable by a user.

According to FIG. 9, interfering ribs, which may project in an elevated manner from the plane underlayment, may be formed as interfering structures 84 at the inner side of the corpus 12. In addition, interfering contours may be formed as accommodating structures 82 at the bottom of the assortment boxes 80 and/or 80', which may be open on the top. Three assortment boxes 80, which are depicted in FIG. 9 in the upper row as well as in the left column of the lower row, may stand with respectively four bases 86 in four accommodating recesses 24, wherein the interfering structures 84 and the accommodating structures 82 may not stand in each other's way interferingly such that the three described assortment boxes 80 may be correctly accommodated at the corpus 12. In contrast to the three assortment boxes 80, which may be correctly accommodated at the corpus 12, the assortment box 80' in the lower row and the right column according to FIG. 9 may be rotated by 180°, whereby the accommodating structure 82 thereof and the interfering structures 84 of the corpus 12 may stand in each other's way interferingly, such that the assortment box 80 may not be accommodated stably at the corpus 12. Thus, the described structural features may provide that the assortment boxes 80, 80' may be deposited stably in the accommodating recesses 24 in exactly only one orientation. A positioning of the assortment boxes 80, 80', which may be rotated by 180° or 90°, may be mechanically made impossible.

The accommodating structures having the reference numerals 18, 20, 22 provided at the corpus 12 as well as accommodating structures, which are not shown in FIG. 9 (which may be realized as positioning bars 88 in FIG. 10), and which may be provided at the lid 14, on the one hand, and the accommodating container 80, on the other hand, may furthermore be adapted to each other such that, in the closed state of the suitcase 10, the lid 14 may make impossible a falling (or dropping) out of bulk material from the accommodating container 80. For example, the accommodating container 80 may be protected from an undesired displacing (or shifting) movement at the bottom side by the accommodating structures having the reference numerals 18, 20, 22, and may be protected from an undesired displacing movement at a circumferential edge, which may be open at the top (at which goods to be transported may be inserted in the accommodating container 80, which may be open at the top, or may be withdrawn therefrom), by accommodating structures of the lid 14. Thereby, goods to be transported, which even may have a small volume, may be protected from a falling out from the accommodating container 80, if the suitcase 10 is handled in the closed state.

Figure 10:
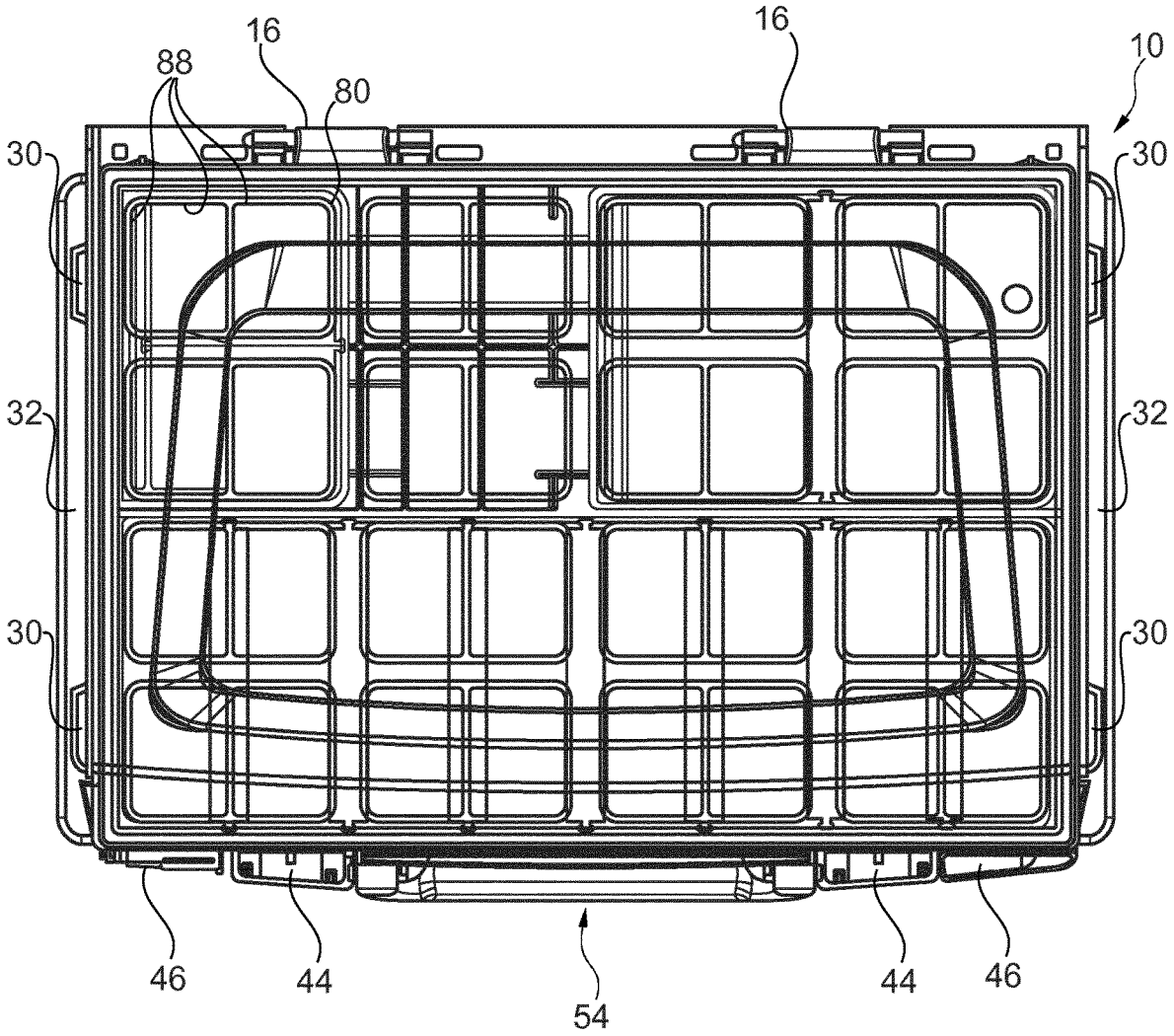
FIG. 10 shows a suitcase according to another exemplary embodiment example of the invention, having a transparent lid.

FIG. 10 shows a suitcase 10 according to another exemplary embodiment example of the invention, possibly having a transparent lid 14. In FIG. 10, there is shown a suitcase 10 possibly having a transparent lid 14, which may allow a view from the outside into the interior of the suitcase 10, even if the lid 14 and the corpus 12 may be arranged in the closed state with each other.

FIG. 10 shows an embodiment example of a suitcase 10 possibly having a transparent lid 14, at the inner surface of which positioning bars 88 may project in an elevated manner, wherein the bars may be surrounded by a circumferential edge, which may be open at the top, of the respective assortment box 80. In this way, an assortment box 80 may be accommodated in the accommodating recesses 24 at the lower side and may be confined by the positioning bars 88 at the upper side, so as to possibly be fixed with an allowance for clearance both at the upper side and at the bottom side. It may be avoided by the positioning bars 88 that bulk material of small volume (or small size) (for example flat washers) fall out from assortment boxes 80, which may be open at the top. In the example shown, the assortment box 80 may have an area, which may be more than double the area of each one of the two positioning bars 88, which may be surrounded by the box. However, an assortment box 80 having another size may also surround only one positioning bar 88, or more than two positioning bars 88.

Supplementary, it is to be noted that "having" or "comprising" does not exclude other elements or steps, and that "a" or "an" does not exclude a plurality. In addition, it is to be noted that features or steps, which have been described above with reference to one of the above embodiment examples, may also be used in combination with other features or steps of other embodiment examples that have been described above. Reference numerals in the claims are not to be construed as limitations.

The invention claimed is:

1. Suitcase for transporting goods to be transported, the suitcase having:

a corpus;

a lid, which is connected, or connectable, to the corpus;

coupling structures provided at the corpus;

wherein in a closed state, an accommodating space for accommodating goods to be transported is formed inaccessibly from the outside between the corpus and the lid;

wherein in an open state, the accommodating space is accessible from the outside;

wherein the coupling structures are configured such that the suitcase and a similar other suitcase having similar coupling structures, by the coupling structures, are, one upon the other, selectively:

in a state I vertically detachably and protected against displacement stackable, wherein a part of the coupling structures, which is configured to make the suitcase and the other suitcase vertically detachably stackable, is configured in the form of guide rails of the suitcase provided at outer, upper-side edge sections of the corpus of the suitcase and in the form of lower-side coupling projections of the other suitcase, which are configured to co-operate with the guide rails of the suitcase in the coupled state, provided at outer, lower-side edge sections of the corpus of the other suitcase, wherein the coupling projections of the other suitcase are configured to be put on the guide rails of the suitcase; and a part of the coupling structures, which is configured to protect the suitcase against displacement against the other suitcase, is implemented in the form of latching cams of the suitcase provided at outer upper-side edge sections of the corpus of the suitcase and in the form of latching bases of the other suitcase having lower-side accommodating notches provided at outer lower-side edge sections of the corpus of the other suitcase, wherein the accommodating notches of the other suitcase are configured to co-operate with the latching cams of the suitcase in the stacked state by a form-fit between the accommodating notches of the other suitcase provided at the latching cams of the suitcase; and in a state II and a state III vertically non-detachably coupleable with each other;

wherein the coupling structures are configured such that the suitcase and the other suitcase, in the state II and the state III, in which they are one upon the other vertically non-detachably coupled with each other, are selectively:

in the state II displaceable relative to each other, wherein the coupling projections of the other suitcase are configured to be put on the guide rails of the suitcase and the other suitcase is configured to be vertically lifted with respect to the suitcase such that the coupling projections of the other suitcase are arranged at a height between the latching cams of the suitcase and the guide rails of the suitcase, and the other suitcase is configured to be displaced over the suitcase such that the coupling projections of the other suitcase are pulled in between the latching cams of the suitcase and the guide rails of the suitcase, wherein a detaching of the other suitcase from the suitcase is made impossible by a form-fit between the coupling projections of the other suitcase on the one hand and at least one of the latching cams of the suitcase and the guide rails on the other hand; or in the state III protectable against displacement relative to each other by actuating the coupling structures, wherein a part of the coupling structures, which is configured to protect the suitcase and the other suitcase against displacement relative to each other, is configured in the form of accommodating notches of the suitcase and latching sliders of the other suitcase, the latching sliders of the other suitcase are configured to co-operate with the accommodating notches of the suitcase, wherein the latching sliders of the other suitcase are configured to be insertable into the accommodating notches of the suitcase, wherein starting from the state II, the latching sliders of the other suitcase are configured to be inserted into the accommodating notches of the suitcase by a vertical displacing movement.

2. Suitcase according to claim 1, wherein a part of the coupling structures contribute both to the vertically detachable, protected against displacement stacking and to the vertically non-detachable coupling with each other.

3. Suitcase according to claim 1, wherein a coupling direction, along which the suitcase and the other suitcase can be arranged one upon the other for coupling, and a stacking direction, along which the suitcase and the other suitcase can be arranged one upon the other for stacking, are identical.

4. Suitcase according to claim 1, wherein one of the following options (a) to (e) is implemented:

(a) a part of the coupling structures, which contribute to the protecting against displacement in the one upon the other vertically non-detachably coupled with each other state, is configured, and is actuable, independently from another part of the coupling structures, which contributes both to the vertically detachable, protected against displacement stacking and also to the vertically non-detachable coupling with each other;

(b) a part of the coupling structures, which is configured to make the suitcase and the other suitcase stackable one upon the other vertically non-detachably and to protect the suitcase and the other suitcase against displacement, is configured in the form of latching cams of the suitcase provided at outer upper-side edge sections of the corpus of the suitcase and in the form of latching bases of the other suitcase, which co-operate with the latching cams of the suitcase in the stacked state, and which have lower-side accommodating notches of the other suitcase provided at outer, lower-side edge sections of the corpus of the other suitcase;

(c) wherein the latching cams form a part of the guide rails;

(d) wherein the coupling projections form a part of the latching bases; and (e) wherein the latching bases extend downwards vertically beyond a bottom surface of the corpus, such that the suitcase is depositable at the latching bases onto an underground.

5. Suitcase according to claim 1, wherein at least a part of the coupling structures is provided at side surfaces of the corpus.

6. Suitcase according to claim 1, wherein the coupling structures are provided exclusively at the corpus.

7. Suitcase according to claim 1, wherein in the suitcase is configured to be selectively stackable or coupleable with the similar suitcase having an equal or different depth.

8. Suitcase according to claim 1, further having a handle provided at a side surface of the corpus, which handle is tiltable between a state folded to a side surface of the corpus and a state folded away from the side surface, wherein the handle has a hard component for stabilizing and a soft component for touching the suitcase by a user upon carrying the suitcase.

9. Suitcase according to claim 1, having a hinge, which foldably connects the corpus and the lid with each other, and which is configured to be capable to fold over the suitcase between the closed state and the open state.

10. Suitcase according to claim 9, wherein latching bases extend downwards vertically beyond a bottom surface of the corpus, such that the suitcase is depositable at the latching bases onto an underground, wherein the latching bases and the hinge are configured such that the hinge is spaced non-contactingly with respect to the underground, if the suitcase lies on the underground by the latching bases.

11. Suitcase according to claim 1, wherein the corpus is configured non-detachably from the lid, so as to be applicable, in the detached state, as a drawer.

12. Suitcase according to claim 1, wherein accommodating structures for accommodating at least one accommodating container are formed at an inner side of the corpus;

(a) wherein the suitcase has the at least one accommodating container, which is accommodated or accommodatable at the inner side;

(b) wherein the accommodating structures and corresponding outer structures of the accommodating container are adapted to each other, such that an accommodating of the at least one accommodating container at the inner surface is enabled only in a pre-determined orientation and is made impossible in other orientations;

(c) wherein the accommodating structures and corresponding outer structures of the accommodating container are adapted to each other, such that an accommodating of the at least one accommodating container at the inner surface is enabled at variable positions, which are selectable by a user;

(d) wherein the accommodating structures and the accommodating container are adapted to each other, such that, in the closed state, the lid makes impossible a dropping out of goods to be transported from the accommodating container.

13. Suitcase according to claim 1, wherein at least a portion of the lid is transparent.

14. Suitcase according to claim 1, wherein a document holder is fixed at an inner side of the lid.

15. An arrangement having:

a suitcase according to claim 1;

an additional body, which has coupling structures;

wherein the suitcase and the additional body are configured such that the coupling structures of the suitcase and the coupling structures of the additional body can be brought in an operative connection with each other, such that the suitcase and the additional body are selectively:

vertically detachably, protected against displacement stackable; or vertically non-detachably coupleable with each other.

16. The arrangement according to claim 15, wherein the additional body is an additional suitcase or a storage box.

17. The arrangement according to claim 15, wherein the additional body has another depth than the suitcase.

18. Method for handling a suitcase for transporting goods to be transported, the method comprising:

handling a corpus and a lid, which is connected, or connectable, to the corpus, so as to transform the suitcase between a closed state, in which the corpus and the lid form an accommodating space for accommodating goods to be transported inaccessibly from the outside, and an opening state, in which the accommodating space is accessible from the outside;

handling coupling structures provided at the corpus, so as, by the coupling structures, to selectively, one upon the other, by:

in a state I, stacking the suitcase and a similar other suitcase having similar coupling structures vertically detachably and protected against displacement, wherein a part of the coupling structures, which is configured to make the suitcase and the other suitcase vertically detachably stackable, is configured in the form of guide rails of the suitcase provided at outer, upper-side edge sections of the corpus of the suitcase and in the form of lower-side coupling projections of the other suitcase, which are configured to co-operate with the guide rails of the suitcase in the coupled state, provided at outer, lower-side edge sections of the corpus of the other suitcase, wherein the coupling projections of the other suitcase are put on the guide rails of the suitcase; and a part of the coupling structures of the suitcase, which is configured to protect the suitcase against displacement against the other suitcase, is implemented in the form of latching cams of the suitcase provided at outer upper-side edge sections of the corpus of the suitcase and in the form of latching bases of the other suitcase having lower-side accommodating notches of the other suitcase provided at outer lower-side edge sections of the corpus of the other suitcase, wherein the accommodating notches of the other suitcase are configured to co-operate with the latching cams of the suitcase in the stacked state by a form-fit between the accommodating notches of the other suitcase provided at the latching cams of the suitcase, or in a state II and a state III coupling the suitcase to the other suitcase vertically non-detachably with each other;

wherein the coupling structures are configured such that the suitcase and the other suitcase are, by the coupling structures, in the state, one upon the other vertically non-detachable coupled with each other state, are selectively in the state II displaceable relative to each other, wherein the coupling projections of the other suitcase are put on the guide rails of the suitcase and the other suitcase is vertically lifted with respect to the suitcase such that the coupling projections of the other suitcase are arranged at a height between the latching cams of the suitcase and the guide rails of the suitcase, and the other suitcase is displaced over the suitcase such that the coupling projections of the other suitcase are pulled in between the latching cams of the suitcase and the guide rails of the suitcase, wherein a detaching of the other suitcase from the suitcase is made impossible by a form-fit between the coupling projections of the other suitcase on the one hand and at least one of the latching cams of the suitcase and the guide rails of the suitcase on the other hand; and in the state III protectable against displacement relative to each other by actuating the coupling structures, wherein a part of the coupling structures, which is configured to protect the suitcase and the other suitcase against displacement relative to each other, is configured in the form of accommodating notches of the suitcase and latching sliders of the other suitcase, the latching sliders of the other suitcase are configured to co-operate with the accommodating notches of the suitcase, wherein the latching sliders of the other suitcase are inserted into the accommodating notches of the suitcase, wherein starting from the state II, the latching sliders of the other suitcase are inserted into the accommodating notches of the suitcase by a vertical displacing movement.

* * * * *